US007323966B2

(12) United States Patent
Yoshikawa

(10) Patent No.: US 7,323,966 B2
(45) Date of Patent: Jan. 29, 2008

(54) THERMAL PELLET INCORPORATED THERMAL FUSE AND METHOD OF PRODUCING THERMAL PELLET

(75) Inventor: Tokihiro Yoshikawa, Koka (JP)

(73) Assignee: NEC SCHOTT Components Corporation, Koka-shi (JP)

( * ) Notice: Subject to any disclaimer, the term of this patent is extended or adjusted under 35 U.S.C. 154(b) by 343 days.

(21) Appl. No.: 10/971,166

(22) Filed: Oct. 22, 2004

(65) Prior Publication Data

US 2005/0088272 A1 Apr. 28, 2005

(30) Foreign Application Priority Data

Oct. 28, 2003 (JP) ..... 2003-367582
Jun. 2, 2004 (JP) ..... 2004-164878

(51) Int. Cl.
*H01H 85/06* (2006.01)
*H01H 85/055* (2006.01)

(52) U.S. Cl. ..... 337/416; 337/401; 337/407

(58) Field of Classification Search ..... 337/401, 337/407, 416; 29/623
See application file for complete search history.

(56) References Cited

U.S. PATENT DOCUMENTS 3,180,958 A 4/1965 Merrill
3,281,559 A 10/1966 Ebensteiner
3,529,270 A 9/1970 Kozacka
3,727,164 A 4/1973 Cartier et al.
3,781,737 A * 12/1973 Henry ..... 337/407
3,815,071 A 6/1974 Sleeter
3,930,215 A 12/1975 Senor
4,001,754 A 1/1977 Plasko
4,065,741 A * 12/1977 Sakamoto et al. ..... 337/407
4,068,204 A * 1/1978 Iwanari et al. ..... 337/408
4,084,147 A 4/1978 Mlyniec et al.
4,184,139 A * 1/1980 Hara ..... 337/407
4,189,697 A * 2/1980 Hara ..... 337/407

(Continued)

FOREIGN PATENT DOCUMENTS

DE 24 57 223 10/1975

(Continued)

OTHER PUBLICATIONS

U.S. Appl. No. 10/512,167, filed on Oct. 20, 2004, Yoshikawa.
U.S. Appl. No. 11/229,489, filed on Sep. 15, 2005, Yoshikawa et al.

*Primary Examiner*—Anatoly Vortman
(74) *Attorney, Agent, or Firm*—W. F. Fasse; W. G. Fasse

(57) ABSTRACT

A thermal fuse incorporating a thermal pellet has its operating temperature, or heat distortion temperature, adjusted and the thermosensitive material of the pellet avoids deformation, modification or similar deficiency if it is exposed to a severe external environment. The inexpensive thermal fuse provides a wider range from which an operating temperature can be selected, improved insulation resistance after operation, faster response speed in operation, and enhanced strength of the thermal pellet. The thermosensitive material is formed of a thermoplastic resin corresponding to a high molecular weight substance. The thermal pellet's heat distortion temperature is adjusted by a temperature setting method. An enclosure of the fuse has a metal casing with a spring member's strong and weak compression springs both accommodated therein and hermetically sealed.

27 Claims, 6 Drawing Sheets

U.S. PATENT DOCUMENTS

| | | | | | |
|---|---|---|---|---|---|
| 4,259,656 | A | | 3/1981 | Smith | |
| 4,276,531 | A | | 6/1981 | Davis | |
| 4,276,532 | A | * | 6/1981 | Aoki | 337/408 |
| 4,281,309 | A | | 7/1981 | Olson | |
| 4,286,248 | A | | 8/1981 | Hara | |
| 4,322,705 | A | * | 3/1982 | Hara | 337/407 |
| 4,384,267 | A | | 5/1983 | Aoki | |
| 4,480,247 | A | * | 10/1984 | Hara | 337/407 |
| 4,514,718 | A | | 4/1985 | Birx | |
| 4,529,957 | A | * | 7/1985 | Hara | 337/407 |
| 4,630,023 | A | | 12/1986 | Gawron et al. | |
| 4,821,010 | A | * | 4/1989 | Plasko | 337/405 |
| 4,973,932 | A | | 11/1990 | Krueger et al. | |
| 5,357,234 | A | | 10/1994 | Pimpis et al. | |
| 5,473,303 | A | * | 12/1995 | Hohider | 337/401 |
| 5,532,030 | A | | 7/1996 | Hirose et al. | |
| 5,612,663 | A | | 3/1997 | Hollweck | |
| 6,440,492 | B1 | | 8/2002 | Coran | |
| 6,673,257 | B1 | | 1/2004 | Hudson | |
| 6,710,310 | B2 | | 3/2004 | Hantz | |
| 6,982,112 | B2 | | 1/2006 | Coran | |
| 2003/0112117 | A1 | | 6/2003 | Miyashita et al. | |
| 2003/0220460 | A1 | | 11/2003 | Merfeld | |
| 2006/0208845 | A1 | | 9/2006 | Yoshikawa | |

FOREIGN PATENT DOCUMENTS

| | | |
|---|---|---|
| EP | 1120432 | 8/2001 |
| EP | 1 308 974 | 5/2003 |
| GB | 2 011 724 | 7/1979 |
| JP | 50-138354 | 11/1975 |
| JP | 51-145538 | 11/1976 |
| JP | 52-144046 | 12/1977 |
| JP | 57-094142 | 6/1982 |
| JP | 57-103647 | 6/1982 |
| JP | 57-140034 | 9/1982 |
| JP | 60-138819 | 7/1985 |
| JP | 62-246217 | 10/1987 |
| JP | 02-281525 | 11/1990 |
| JP | 05-135649 | 6/1993 |
| JP | 05-307925 | 11/1993 |
| JP | 06-12594 | 3/1994 |
| JP | 2551754 | 8/1996 |
| JP | 09-282992 | 10/1997 |
| JP | 10-177833 | 6/1998 |
| JP | 11-111135 | 4/1999 |
| JP | 11-238440 | 8/1999 |
| JP | 2001-049092 | 2/2001 |
| JP | 2002-163966 | 6/2002 |
| JP | 2003-317589 | 11/2003 |
| JP | 2003-317590 | 11/2003 |
| JP | 2004-095524 | 3/2004 |
| JP | 2004-119255 | 4/2004 |
| KR | 2004-101534 | 12/2004 |

* cited by examiner

THERMAL PELLET INCORPORATED THERMAL FUSE AND METHOD OF PRODUCING THERMAL PELLET

BACKGROUND OF THE INVENTION

1. Field of the Invention

The present invention relates generally to thermal pellet incorporated thermal fuses and methods of producing thermal pellets used therefor, and particularly to thermal pellet incorporated thermal fuses employing thermoplastic resin as a thermosensitive material.

2. Description of the Background Art

A thermal fuse is generally classified into two types depending on the thermosensitive material used: a thermal pellet incorporated thermal fuse employing a non-conductive thermosensitive substance; and a thermal fuse using fusible alloy employing a conductive, low melting alloy. They are both a so-called, non-revertive thermal switch operating at a prescribed temperature to interrupt an electric current of equipment, apparatuses and the like or allow a conduction path to conduct to protect them as the surrounding temperature increases. It operates at a temperature determined by the thermosensitive material used. Typically, it is offered in products as a protective component functioning at a temperature ranging from 60° C. to 240° C. on a rated current ranging from 0.5 A to 15 A and it is an electrical protection method allowing an initial conducting or interrupt state for ordinary temperature to be inverted at a predetermined operating temperature to provide an interrupt or conducting state. The thermal pellet incorporated thermal fuse typically employs a non-conductive thermal pellet, which is accommodated in an enclosure having opposite ends with a lead respectively attached thereto, and includes a compression spring or the like that acts to exert pressure on a movable conductor. The thermal pellet is formed of a chemical agent having a prescribed melting temperature, which is molded into a granular state and then formed into a pellet.

Conventionally, practically used thermal pellet incorporated thermal fuses employ a thermal pellet formed typically of a single, organic chemical compound having a known melting point and made into a pellet, and blended with a binder to provide enhanced granulizability, a lubricant to provide uniform filling density, a pigment to classify types of thermal pellets, and the like. For example one such known thermal pellet incorporated thermal fuse using a single organic chemical compound is described in Japanese Patent Laying-Open No. 60-138819. This employs 4-methylumbelliferone as a pure chemical agent (used as an equivalent to an organic chemical compound) for its thermal pellet. Furthermore it has been known to mix two or more types of organic compounds to provide a melting point different from an initial source material. For example, Japanese Patent Laying-Open No. 2002-163966 and Japanese Patent Laying-Open No. 62-246217 both disclose that two or more types of known organic compounds can be mixed together to produce a eutectic mixture having a different melting point lower than that of an initial organic compound. The publications also describe that the obtained eutectic mixture maintains thermal stability and insulation property. In that case a thermal pellet incorporated thermal fuse employs a thermal pellet member formed of a pure chemical agent and it is said that if an unintended chemical agent is introduced the melting point varies. Accordingly thermal fuses typically employ a thermal pellet formed of a chemical agent such as certified chemically pure reagents or other similar reagents of high purity, and all of these are compounds of low molecular weight. Furthermore, these are all formed of a powdery chemical agent. If the agent is formed of a single type of agent it is molded into a pellet directly. If the agent includes two or more types of agents they are mixed together and then molded into a pellet. For insulation resistance at the time when a thermal pellet fuses, Japanese Utility Model Patent Publication No. 6-12594 proposes an approach to solve a problem associated with pelletization.

Conventionally as a thermosensitive substance a thermosensitive fusible substance including paraffin, a heat resistant non-conductive synthetic resin material, and the like has been used for a thermal fuse, as disclosed for example in Japanese Patent Laying-Open No. 50-138354 and Japanese Utility Model Laying-open No. 51-145538. They both utilize the fusibility that a thermosensitive material itself has. However, they are not commercially used as their selected materials' properties, structures and the like have issues to be addressed.

When a thermal pellet incorporated in a thermal fuse is exposed to high temperature close to its melting point, the thermal pellet can sublimate and thus be reduced in size. Furthermore by deliquescence the thermal pellet can be dissolved due to moisture, water and/or the like. Either case is a cause of a break of the thermal pellet incorporated thermal fuse. As such, the thermal pellet incorporated thermal fuse would hardly be thermally, physically or chemically sufficiently stable and is affected by environment. Furthermore, as it is formed of powder compacted and molded, it has insufficient strength and readily cracks, chips or the like while it is handled in a process for production. The thermal pellet incorporated thermal fuse also has a disadvantage in characteristic such as a low insulation resistance value after operation and for example Japanese Patent Laying-Open No. 2002-163966 and Japanese Utility Model Patent Publication No. 6-12594 raise such an issue. Furthermore in recent years there is an increased demand for a thermal fuse providing a quick response and hence increased response speed. To address the above described disadvantages individual approaches have been proposed. They are, however, individually unsatisfactory and there has not been a proposal in connection with a material that can satisfy all issues uniformly. For example, as will be described later in detail, material with a high insulation resistance value is not necessarily non-deliquescent. Rather, it suffers its higher dissolvability than other materials and it also disadvantageously readily sublimates.

The thermal fuses using the thermal pellet as described above employ a relatively pure chemical agent for the thermosensitive material, and this substance is granulated and molded into a predetermined form to provide the pellet. The pelletized material, however, readily softens, deforms, sublimates, deliquesces and/or the like as it is affected by environmental conditions, and there have been a large number of concerns associated with particular production process steps, and conditions for storage after production, and the like. For example if a pellet is molded from a material itself having deliquescent property, and it is exposed to external air, it deforms, dissolves and/or the like. Accordingly an extreme sealing management must be introduced to block external air. Furthermore, as the pellet is molded from powder, it is small in mechanical strength, and in assembling a thermal fuse a spring's force can deform the pellet, resulting in a defect. Furthermore, if a completed thermal fuse is stored at high temperature in high humidity, the pellet sublimates, deliquesces and/or the like, which can affect the product's longevity and also impair its electrical characteristics. Conventional thermal pellets employing chemical agents, low molecular weight chemical agents in particular, significantly soften and deform when they are exposed to high temperature and high humidity. The pellet thus diminishes in size, resulting in a contact dissociating disadvantageously. Accordingly there has been a need for a thermal pellet incorporated thermal fuse that is hardly affected in use by its surrounding environment, the variation thereof with the passage of time and the like, and also that has the pellet itself free of defects when it is stored in a severe atmosphere, exposed to high temperature and high humidity, toxic gas, and the like.

A conventional thermal fuse that uses resin material utilizes the resin material's fusibility. However, there is not any specifically described method to set an operating temperature, and the operating temperature's precision cannot be satisfactorily obtained. Furthermore, as an accurate operating temperature is not known, lack of practicality and other deficiencies exist, and there has been a demand for a thermal pellet incorporated thermal fuse overcoming such deficiencies. Furthermore, for improving the response speed there has also not been any specific solution indicated, and there is no thermal fuse providing a quick response in practical use. Furthermore, the resin that is used is difficult to select as it has a characteristic varying over a wide range. For example, if the resin material utilizes a melting point of crystalline thermoplastic resin, the melting point significantly varies with the resin's degree of crystallinity, composition and the like, and the fuse's operating temperature cannot be determined solely by the melting point. Without adjustment of an operating temperature, there is only limited thermoplastic resin that can be selected by depending solely on a melting point, and there has not been a material satisfactory for an operating temperature setting range required for practical thermal fuses. Furthermore, even crystalline thermoplastic resin having a melting point has a broad heat absorption peak, which is remote from a material having a narrow heat absorption peak that has been required for thermal fuses, and furthermore for amorphous thermoplastic resin a melting point itself cannot be utilized.

SUMMARY OF THE INVENTION

A physical and chemical property of a thermosensitive material used for a thermal pellet is noted to select a material to be used and a prescribed operating temperature is also ensured by a novel and improved adjustment method to provide a practically usable thermal pellet incorporated thermal fuse. More specifically, a variety of physical and chemical disadvantages of conventional thermal pellets can generally be solved by clarifying a method of setting a temperature to provide a novel and improved thermal pellet incorporated thermal fuse and a method of producing a thermal pellet employed therefor.

In particular, a thermosensitive material is selected and a desired operating temperature can be adjusted by a method of setting a temperature to reduce the thermal pellet's sublimation to provide a thermal pellet with improved characteristic. Furthermore, there is provided a thermal pellet that can be used at high temperature and is thus thermally stable, and has a reduced deliquescence into water, alcohol and the like. Furthermore, there is provided a thermal pellet that is increased in strength to reduce defects such as cracking, chipping and the like, and enhanced in dielectric strength and insulation resistance at high temperature. By achieving this, a thermal pellet incorporated thermal fuse is provided that achieves satisfactory operating temperature precision and response speed and is also usable at high temperature and is thus thermally stable.

If a conventional, pure, low molecular weight chemical agent is used and a melting point is utilized as an operating temperature, a thermosensitive material can be selected from an abundance of several hundreds of thousands of types. If the thermosensitive material is of a high molecular weight substance, however, it introduces a problem in setting an operating temperature and this needs to be solved to allow the fuse to operate with improved precision. Furthermore, there is provided a thermal pellet incorporated thermal fuse that allows a high molecular weight substance to be used to cover a wide range of temperature. In addition, in contrast to conventional teachings, the present invention provides a method employing a thermally, physically and chemically stable thermosensitive material to help to produce a thermal pellet.

To achieve this the present thermal pellet incorporated thermal fuse includes a thermal pellet formed of a thermosensitive material selected from thermosensitive resin of a high molecular weight substance and having its heat distortion temperature adjusted by a temperature setting method to be any desired operating temperature for use. More specifically, the thermal fuse includes: a cylindrical enclosure accommodating a thermal pellet formed of a thermosensitive material molded into a pellet, the thermosensitive material being adapted to thermally deform while it is heated; a first lead member forming a first electrode attached to one opening of the enclosure; a second lead member forming a second electrode attached to the other opening of the enclosure; a movable conductive member accommodated in the enclosure and engaged with the thermal pellet; and a spring accommodated in the enclosure to exert force on the movable conductive member, wherein: the thermal pellet is formed of a high molecular weight substance exhibiting plasticity when it is heated; the thermal pellet is adjusted in degree of thermal deformation by a temperature setting method; when the thermal pellet is heated, the thermal pellet softens or melts at a desired operating temperature to thermally deform; and when the thermal pellet is heated to the desired operating temperature, and a force is exerted on the thermal pellet by the spring, an electric circuit between the first and second electrodes is switched. More specifically, it includes a thermal pellet formed of a thermoplastic resin thermally deforming at a prescribed temperature, a cylindrical enclosure accommodating the thermal pellet, a first lead member close to one opening of the enclosure, a second lead member close to the other opening of the enclosure, and a component having a movable conductive member accommodated in the enclosure and a spring member formed of a strong compression spring and a weak compression spring to function as a switch, and by the temperature setting method a heat distortion temperature allowing the thermal pellet to soften or fuse is adjusted to be a desired operating temperature. In particular, the thermal pellet can be formed of either high molecular weight amorphous thermoplastic resin or crystalline thermoplastic resin. The method, for the amorphous thermoplastic resin, adjusts the desired operating temperature within a range in temperature higher than a softening point (Tg) and, for the crystalline thermoplastic resin, utilizes a difference in temperature of fusion temperature characteristics represented by extrapolated initial melting temperature (Tim) and peak melting temperature (Tpm). Furthermore, for the latter, a degree of crystallinity, an annealing step, or adding a nucleus creator can also be used for adjusting the desired operating temperature.

Furthermore the present temperature setting method can adjust an operating temperature by employing a spring to set as desired a load exerted on the thermal pellet. Furthermore, preferably, olefin resin can be used, thermoplastic resin polymerization or copolymerization can be utilized, elastomer or polymer can be blended, or a plasticizer or the like can be added to set heat distortion temperature of the thermal pellet itself. Furthermore, the pellet's mechanical strength can be varied to provide varied heat distortion temperature. More specifically, this can be done by adding a filler or the like, changing the pellet's size to vary a load on the pellet, introducing or not introducing a plate between the pellet and a spring, changing the plate's size, or changing similar physical dimensions.

The present thermal pellet incorporated thermal fuse includes: a thermal pellet formed of a crystalline, high molecular weight substance thermally deforming at a prescribed temperature; a cylindrical enclosure accommodating the thermal pellet; a first lead member forming a first electrode attached to one opening of the enclosure; a second lead member forming a second electrode attached to the other opening of the enclosure; a movable conductive member engaged with the thermal pellet located in the enclosure; and a spring exerting force on the movable conductive member, the thermal pellet thermally deforming at a desired operating temperature to switch an electric circuit between the first and second electrodes, wherein the thermal pellet's operating temperature is set by a method of setting a temperature, as desired. The thermal pellet is formed of a thermosensitive material fusing or softening at a prescribed temperature, preferably using crystalline thermoplastic resin as a base material, and thereto a variety of additives, reinforcement materials or fillers can be added. Furthermore, to obtain a desired operating temperature, a main material or crystalline high molecular weight substance or crystalline thermoplastic resin can be changed in degree of polymerization, or other similar method can be introduced to adjust a melting point. More specifically, if it is necessary to adjust an operating temperature, main materials are selected and in addition they are polymerized, copolymerized, plasticized, or blended together as desired. Furthermore, a catalyst used in synthesizing and purifying these base materials or high molecular weight substance or thermoplastic resin can be varied to provide different mechanical strength, a different molecular weight profile and a different melting point. The thermal pellet thus obtained can be prevented from diminishing to a reduced mass associated with deliquescence or sublimation. Deliquescence into water is also hardly observed, and improved dielectric strength characteristic can be provided and increased strength can also be achieved to eliminate cracking and chipping and hence defects. As such, the present thermal pellet incorporated thermal fuse includes: a thermal pellet formed of a crystalline, high molecular weight substance fusing or softening at a prescribed temperature; a cylindrical enclosure accommodating the thermal pellet; a first lead member forming a first electrode attached to one opening of the enclosure; a second lead member forming a second electrode attached to the other opening of the enclosure; a movable conductive member accommodated in the enclosure and engaged with the thermal pellet; and a spring accommodated in the enclosure to exert a force on the movable conductive member, the thermal pellet thermally deforming at a desired operating temperature to switch an electric circuit between the first and second electrodes, wherein the thermal pellet is selected in accordance with a mass reduction degree depending on deliquescence or sublimation of the pellet by itself.

The present invention provides a method of fabricating a thermal pellet incorporated in a thermal fuse, the thermal fuse including a thermal pellet formed of a high molecular weight substance thermally deforming at a prescribed temperature, a cylindrical enclosure accommodating the thermal pellet, a first lead member forming a first electrode attached to one opening of the enclosure, a second lead member forming a second electrode attached to the other opening of the enclosure, a movable conductive member accommodated in the enclosure and engaged with the thermal pellet, and a spring accommodated in the enclosure to exert force on the movable conductive member, the thermal pellet thermally deforming at a desired operating temperature to switch an electric circuit between the first and second electrodes, wherein the thermal pellet is molded by injection molding, extrusion molding, sheet punching and then molding, or re-fusion molding. Conventionally a thermal pellet has been produced by molding a powder. In contrast, the present invention allows fusion molding and accordingly allows injection molding, extrusion molding, sheet punching and other similar processes. It cannot only provide a thermal pellet with a conventional geometry but also help to form a thermal pellet additionally provided with a cavity, a recess, a hole and/or the like. Such a degree of freedom in molding can help to provide a thermal pellet with quick response ability and also contribute to reduced cost for production. A thermal fuse that is inexpensive and provides a high response speed can thus be provided. Furthermore, to improve characteristics of a thermal pellet having a problem in gas barrier property, hygroscopicity and/or the like, preferably, a different thermoplastic resin is provided at a portion of the pellet or entirely.

In the present invention a thermal pellet is formed of a thermosensitive material formed solely of thermoplastic resin of a high molecular weight substance, and polymerized, copolymerized or blended, and a variety of additives are used. Such a method of setting a temperature allows a thermal fuse to be formed of a wide range of thermosensitive material and have a wider operating temperature range and in addition thereto not only a conventional temperature range can be compensated for but also a material thermally stable at a higher temperature range can also be selected. Furthermore, as the thermal pellet's physical and chemical properties are considered in selecting and using an additive, the pellet can be more readily molded, and the molded thermal pellet can be increased in strength and prevented from deformation and alteration to achieve increased lifetime and increased operation stability. In particular, the simplified fabrication process and the pellet's increased strength can be helpful in simplifying a component of the thermal pellet incorporated thermal fuse to provide the fuse inexpensively. Furthermore, if the thermal fuse is stored over time at high humidity or in an ambient of hazardous gas, the fuse can be stable over a long period of time and prevented from corrosion and impaired insulation property, and not only in storage but also in use the fuse can be prevented from impaired electrical characteristics and other similar performance problems and also prevented from variation over time to allow the fuse to operate constantly at a prescribed temperature accurately to significantly contribute to increased stability and reliability and other similar practical effects.

Furthermore the present temperature setting method allows a spring member to have strong and weak compression springs in a combination adjusted to vary pressure so that any desired operating temperature can be obtained regardless of the thermosensitive material's crystallinity or amorphousness. For crystalline thermoplastic resin, a difference in temperature between extrapolated initial melting temperature (Tim) and peak melting temperature (Tpm) as defined by JIS-K-7121 can be utilized to provide a thermal pellet incorporated thermal fuse capable of setting a wide range of operating temperature. Furthermore, for amorphous thermoplastic resin, heat distortion temperature can be adjusted to fall within a temperature range higher than a softening point (Tg) and the resin can be pressed to provide a desired thermal pellet incorporated thermal fuse. Another method of setting a temperature can copolymerize thermoplastic resin itself, blend elastomer or polymer, or add a filler or a plasticizer represented for example by talc to adjust the heat distortion temperature. In other words, in the present invention, a variation in the heat distortion temperature provided by chemically and physically processing a thermoplastic resin of a high molecular weight substance and a spring pressure represented by the main body's structure allow a desired heat distortion temperature to be implemented to adjust and set an operating temperature and provide other similar significant effects.

The present thermal pellet incorporated thermal fuse can be used in an AC adapter, a charger, a motor, a battery or other similar component used in mobile equipment, communications equipment, office equipment, vehicle mounted equipment and other similar various household electric appliances as a protective component accurately detecting abnormal overheat and interrupting a circuit at a prescribed temperature rapidly or allowing the circuit to conduct.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
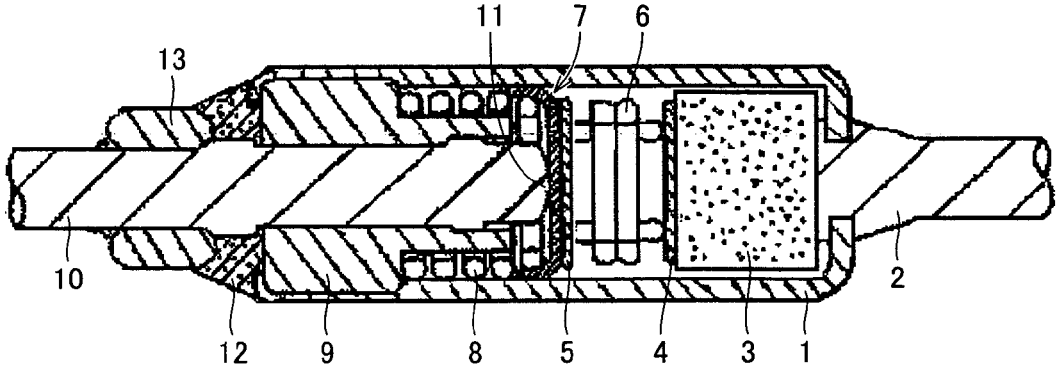
FIG. 1 is a cross section of the present thermal pellet incorporated thermal fuse prior to operation.

The present thermal pellet incorporated thermal fuse includes: a thermal pellet formed of a thermoplastic resin of a high molecular weight substance thermally deforming at a prescribed operating temperature; a cylindrical metal casing (hereinafter also referred to as an "enclosure") accommodating the thermal pellet; a first lead member crimped and fixed and thus attached to the metal casing at one opening to have the casing's internal wall as a first electrode; an insulating bushing attached to the casing at the other opening; a second lead member penetrating the bushing and having an end as a second electrode; a movable contact (hereinafter also referred to as a "movable conductive member") accommodated in the casing and electrically connected to the casing's inner wall to engage with the thermal pellet; and a compression spring member (hereinafter also referred to as a "spring member") accommodated in the casing to exert a force and thus act on the movable contact. The thermal pellet is formed of a high molecular weight substance exhibiting plasticity when it is heated. The pellet's thermal deformation degree is adjusted by a method of setting a heat distortion temperature. The spring member exerts a force, which is received by the pellet, and when the pellet is heated and a desired operating temperature is reached the pellet softens or fuses and thus thermally deforms, and thereby the first and second electrodes are interrupted or electrically connected, as switched.

More specifically, the compression spring member is formed of strong and weak compression springs, and the strong compression spring acts against the weak compression spring's resilience to push and thus bring the movable contact into contact with the second electrode. In particular, the strong compression spring is arranged between the pellet and the contact with a respective pressure plate interposed at the spring's opposite ends to facilitate fabrication and also provide a stable spring operation. When such a thermal fuse has the temperature of the thermal pellet increased to the heat distortion temperature, the pellet deforms and the weak compression spring exerts a force to move the movable contact to interrupt a circuit to provide a thermal fuse that is normally turned on, and is turned off for an abnormal condition. As described herein, the present invention employs thermoplastic resin which is not necessarily 100% crystalline: it also includes semicrystalline thermoplastic resin, amorphous thermoplastic resin and the like and is used in combination with the temperature setting method.

Table 1 shows crystalline thermoplastic resins that can be used as a thermosensitive material for a pellet of the present thermal pellet incorporated thermal fuse, and their melting points. The present method of setting a temperature can be employed to adjust a desired operating temperature in accordance with the resins' chemical and physical properties. By contrast, amorphous thermoplastic resin that can be used for the thermosensitive material includes polyvinyl chloride (PVC), polyvinyl acetate (PVAc), polystyrene (PS), polyvinyl butyral (PVB), polymethylmethacrylate (PMMA), polycarbonate (PC), modified poly(phenylene ether) (modified PPE), and the like.

TABLE 1

| Crystalline thermoplastic resins | Melting Point (° C.) | Crystalline Thermoplastic Resins | Melting Point (° C.) |
|---|---|---|---|
| polyethylene | 137 | poly-p-xylene | 375 |
| polypropylene | 176 | polyoxymethylene | 181 |
| poly-1-butene | 126 | polyethylene oxide | 66 |
| poly-1-pentene | 75 | polypropylene oxide | 75 |
| poly-1-dodecene | 45 | poly-1-methoxybutadiene | 118 |
| poly-1-octadecene | 76 | polyvinyl methyl ether | 144 |
| poly-3-methyl-1-butene | 310 | polyvinyl ethyl ether | 86 |
| poly-4-methyl-1-pentene | 250 | polyvinyl-n-propyl ether | 76 |
| poly-4-methyl-1-hexene | 188 | polyvinyl isopropyl ether | 190 |
| poly-5-methyl-1-hexene | 130 | polyvinyl-n-butyl ether | 64 |
| 1,2-polybutadiene (syndiotactic) | 154 | polyvinyl tert. butyl ether | 260 |
| 1,2-polybutadiene (isotactic) | 120 | polyvinyl neopentyl ether | 216 |
| 1,4-trans-polybutadiene | 148 | polyvinyl benzyl ether | 162 |
| 1,4-trans-poly-2,3-dimethyl butadiene | 260 | polyvinyl-2-chloroethyl ether | 150 |
| polyisobutylene | 128 | polyvinyl-2-methoxyethyl ether | 73 |
| polyvinyl cyclohexane | 305 | polyisopropyl acrylate (isotactic) | 162 |
| polystyrene (isotactic) | 240 | poly tert. butyl acrylate | 193 |
| poly-m-methyl styrene | 215 | polymethyl methacrylate (isotactic) | 160 |
| poly-2,4-dimethyl styrene | 310 | polyethlene terephtalate | 267 |
| poly-2,5-dimethyl styrene | 340 | polytrimethylene terephthalate | 233 |
| poly-3,5-dimethyl styrene | 290 | polyhexamethylen adipamide (nylon 6-6) | 265 |
| poly-3,4-dimethyl styrene | 240 | polyhexamethylen sebacamide (nylon 6-10) | 227 |
| poly-o-fluorostyrene | 270 | nylon 9-9 | 175 |
| poly-p-fluorostyrene | 265 | nylon 10-9 | 214 |
| polytramethylene terephthalate | 232 | nylon 10-10 | 210 |
| polypentamethylene terephthalate | 134 | cellulose triacetate | 306 |
| polyhexamethylene terephthalate | 160 | cellulose tripropionate | 234 |
| polyoctamethylene terephthalate | 132 | cellulose tributyrate | 183 |
| polynonamethylene terephthalate | 85 | cellulose trivalerate | 122 |
| polydecamethylene terephthalate | 138 | cellulose tricaproate | 94 |
| polyethylene isophthalate | 240 | cellulose triheptylate | 88 |
| polytrimethylene isophthalate | 132 | polyvinyl chloride | 212 |
| polytetramethylene isophthalate | 152 | polyvinylidene chloride | 198 |
| polyhexamethylene isophthalate | 140 | polychloroprene | 80 |
| polyethylene sebacate | 76 | polyvinyl fluoride | 200 |
| polytetramethylene sebacate | 64 | polytetrafluoroallene | 126 |
| polydecamethylene sebacate | 80 | polychlorotrifluoroethylene | 220 |
| polyethylene adipate | 50 | polytetrafluoroethylene | 327 |
| polydecamethylene adipate | 80 | polyacrylonitrile | 317 |
| polydecamethylene azelate | 69 | polycarbonate (bis phenol-a) | 220 (267) |
| polycaproamide (nylon 6) | 225 (215) | poly-n-isopropyl acrylamide | 200 |
| nylon 11 | 194 | poly-3,3'-bischloromethyl oxacyclobutane | 180 |

In the present invention the amorphous thermoplastic resin is used to produce the thermal pellet, the present temperature setting method enables thermal deformation at an operating temperature adjusted to fall within a range in temperature of equal to or higher than a softening point (Tg) to obtain a thermal pellet incorporated thermal fuse operating for abnormality.

Furthermore, also as partially listed in Table 1, the present thermal fuse can use a thermal pellet formed of crystalline thermosensitive resin including low-density polyethylene (LDPE), linear low-density polyethylene (LLDPE), high-density polyethylene (HDPE), ultrahigh molecular weight polyethylene (ultrahigh molecular weight PE), very low-density polyethylene (VLDPE) and other similar polyethylene (PE) as well as polyacetal (POM), polypropylene (PP), ethylene-vinyl acetate copolymer (EVA), ethylene-vinyl alcohol copolymer (EVOH), polymethylpentene (PMP), poly vinylidene fluoride (PVdF), ethylene chloride trifluoride-ethylene copolymer (ECTFE), polychlorotrifluoroethylene (PCTFE), tetrafluoroethylene (PTFE), tetrafluoroethylene-ethylene copolymer (ETFE), tetrafluoroethylene-propylene hexafluoride copolymer (FEP), perfluoroalkoxyalkane (PFA), tetrafluoroethylene-hexafluoropropylene vinylidene fluoride copolymer, tetrafluoroethylene-hexafluoropropylene-ethylene copolymer (EFEP), and other similar fluorine containing resins (FR), and furthermore polyester-based resins such as polybutylene terephthalate (PBT), polyethylene terephthalate (PET), polyethylene naphthalate (PEN), polyphenylene sulfide (PPS), polyamide (PA) 6, PA 6-6, PA 12, PA 11, PA 9T, PA 6T, PA 46, PA 6-10, PA MXD6 and other similar normal chain aliphatic polyamides, polyvinyl alcohol (PVA), polyether ether ketone (PEEK), liquid crystal polymer (LCP), poly(1,4-cyclohexylene dimethylene terephthalate) (PCT), binary copolymer of ethylene and methylacrylate (EMA), binary copolymer of ethylene and ethylacrylate (EEA), binary copolymer of ethylene and butylacrylate (EBA), ternary copolymer of ethylene, acrylic ester and acid anhydride monomer, and the like.

If the crystalline thermoplastic resin is used to produce a thermal pellet that is incorporated in a thermal fuse, a spring can be utilized to exert force so that at an operating temperature set as desired the pellet thermally deforms to interrupt or electrically connect the first and second electrodes, as switched. More specifically, an operating temperature is adjusted by a temperature setting method initially selecting the crystalline thermoplastic resin's melting point as a reference and then determining a heat distortion temperature from extrapolated initial melting temperature (Tim) and extrapolated ending melting temperature (Tem), as desired. For conventional low molecular weight compounds, smaller differences between peak melting temperature (Tpm) and extrapolated initial melting temperature (Tim) are more suitable for material for a thermal pellet employed in a thermal fuse. In accordance with the present invention, a degree of freedom in setting a temperature can be obtained by providing temperatures Tim and Tpm with a range of some extent. In other words, Tim and Tpm can have a difference in temperature equal to or larger than 5° C., or 10° C. depending on the material selected. The Tim and Tpm temperature difference can be utilized to adjust an operating temperature's variation to have a correct value. Furthermore in accordance with the present invention if a single member is used the present temperature setting method can set as desired a value of a load exerting force on the thermal pellet to adjust a different operating temperature thereof.

The present invention is characterized by a method of setting a temperature to adjust a desired operating temperature, and the method includes a method of selecting a crystalline thermoplastic resin depending on a degree of crystallinity to provide improved precision of operation. For example, thermal pellet incorporated thermal fuses require the thermal pellet to be formed of thermosensitive material having a degree of crystallinity of at least 20%, at least 30% or at least 40%, although preferable degree of crystallinity is selected, as determined by how heat distortion temperature varies. Thermoplastic resin's degree of crystallinity can also be adjusted by annealing or adding a nucleus creator, and the thermal pellet's temperature can be set, and its effect is particularly significant for polyolefin resin having high degree of crystallinity. Furthermore, another method of setting a temperature can be done by adjusting copolymerization of thermoplastic resin to be used, blending an elastomer, blending a polymer, or adding a filler or a plasticizer. Furthermore, the thermal pellet's heat distortion temperature can be varied by force exerted on the pellet, and the force can be varied, as desired, by adjusting a value of load of the strong and weak compression springs, adjusting a value of load by changing in size a plate member inserted between the strong compression spring and the pellet, or adjusting the pellet itself in dimension or volume. Furthermore, these approaches can be combined as desired. Furthermore, the pellet's heat distortion temperature can be adjusted by varying the pellet's mechanical strength.

In accordance with the present invention, the thermal pellet can be formed of thermosensitive material formed of two or more types of high molecular weight substances, as indicated in Tables 1 and 2 by way of example. Furthermore, polymer blending and/or polymer alloying can be employed or polymerization or copolymerization or the like can be adjusted to adjust heat distortion temperature. For example, polymerization, copolymerization or polycondensation can provide a thermosensitive material having a different property. More specifically, for ethylene and acrylate copolymerization, and methylacrylate copolymerization in particular, a binary copolymer of ethylene and methylacrylate (EMA) can be obtained. For ethylene and ethylacrylate copolymerization, a binary copolymer of ethylene and ethylacrylate (EEA) can be obtained. For ethylene and butylacrylate, there is a binary copolymer of ethylene and butylacrylate (EBA). Furthermore, there is a ternary copolymer of ethylene, acrylic ester and acid anhydride monomer, or the like. These are helpful in widening a range from which an operating temperature, an important factor for a thermal fuse, is selected. Furthermore, if two types of thermoplastic resin are mixed together, they may be mixed together completely at a molecular level. In general, however, they have phase separation or exhibit poor compatibility. Typically, two types of thermoplastic resin mixed together completely at the molecular level come to exhibit a property intermediate between the two types of thermoplastic resin. Furthermore, if both of their advantages are desired, they can be used in phase separation. For example, PA 6 with rubber (ethylene-propylene rubber) kneaded together may be provided, or PA 6 and the rubber kneaded together may undergo a copolymerization reaction to provide a PA6/ethylene-propylene rubber random copolymer rubber blend. In particular in the present invention, rubber's elasticity can also be noted for a characteristic in strength, however the present invention mainly contemplates modifying a method of production and a process for production to obtain a target melting point. Furthermore, as another combination, HDPE and PA can be blended together and a compatibilizer is added for this version to provide a polymer blend. Furthermore another exemplary blend polymer includes EVA, PA and PP, and EVOH blend polymers. These are examples for forming a film. If each material is independently used in a film, it provides a low gas barrier. Accordingly, it is blended with EVOH, which provides a high gas barrier, to provide a blend polymer providing a high gas barrier.

In accordance with the present invention, styrene resin, polyamide resin, polyester resin and fluorine resin can be selected and polymerized, copolymerized or polycondensed to adjust the heat distortion temperature. Herein, one example is shown: if for polyamide resin, PA6 having a melting point of 220° C. is selected and copolymerized with PA6T, there is obtained a PA6/6T copolymer having a melting point of 295° C. Furthermore, PA6 and PA66 having a melting point of 260° C. copolymerized provide a PA6/66 copolymer having a melting point of 196° C., and for a PA66/6 copolymer a melting point of 243° C. is obtained. Table 2 indicates thermoplastic resins having such crystallinity and their melting points.

TABLE 2

| Thermoplastic Resins | Melting Point (° C.) | Thermoplastic resins | Melting Point (° C.) |
|---|---|---|---|
| low-density polyethylene | 105-110 | polyphenylene sulfide | 288 |
| linear low-density polyethylene | 120-130 | polyamide 6 | 218-221 |
| high-density polyethylene | 130-135 | polyamide 66 | 255-266 |
| ultrahigh molecular weight polyethylene | 135-138 | polyamide 12 | 175-178 |
| polyacetal | 160-175 | polyamide 11 | 186 |

TABLE 2-continued

| Thermoplastic Resins | Melting Point (° C.) | Thermoplastic resins | Melting Point (° C.) |
|---|---|---|---|
| polypropylene | 165-170 | polyamide 9T | 306 |
| polyethylene vinyl alcohol | 160-190 | polyamide 6T | 310 |
| polymethylpentene | 220-240 | polyamide 46 | 295 |
| poly vinylidene fluoride | 171 | polyamide MXD6 | 235-245 |
| polytrifluorochloroethylene-ethylene | 220-245 | polyvinyl alcohol | 180-230 |
| polychlorotrifluoroethylene | 270-310 | polyether ether ketone | 373 |
| polytetrafluoroethylene-propylene hexafluoride | 275 | liquid crystal polymer | 300< |
| polytetrafluoroethylene | 327 | polystyrene | 270 |
| perfluoroalkoxyalkane | 310 | polysulfone (PSU) | 190-288 |
| polytetrafluoroethylene-ethylene | 270 | polybutene (PB) | 124-130 |
| polybutylene terephthalate | 220-227 | polyethylene-methylacrylate | 90-101 |
| polyethylene terephthalate | 250-260 | polyethylene-ethylacrylate | 95-100 |
| polyethylene naphthalate | 252 | polyethylene-butylacrylate | 90-125 |

With polyester resin and fluorine resin copolymer, in particular, a copolymer having a melting point having a relatively wide range can be obtained. In addition, amorphous thermoplastic high molecular rubber, polyester or the like can be combined therewith to provide the thermal pellet with elasticity. For example, styrene elastomer, olefin elastomer, polyamide elastomer, urethane elastomer or polyester elastomer, or a mixture thereof can be combined, and polyolefin resin is effective. More specifically, for combination of polyester type; a polybutylene terephthalate (PBT) and polyether block copolymer is commercially available as Hytrel produced by Du Pont-Toray Co., Ltd. This copolymer has a melting point having a wide range of 154° C. to 227° C. If PBT is singly used to produce a thermal pellet the pellet is increased in hardness and furthermore may crack. PBT provided with an elastic rubber body's function and polyether in a block copolymer can provide a thermal pellet with elasticity. If it is employed in a thermal fuse the fuse can have an adjustable operating temperature, and when the temperature is reached the thermal pellet can smoothly deform and as a result, higher response speed can also be achieved.

For fluorine resin, a variety of copolymers are created by changing copolymer's monomer ratio. In particular, a tetrafluoroethylene-hexafluoropropylene-vinylidene fluoride copolymer can be used at low temperature and can also have its monomer ratio adjusted to allow a melting point to be selected from a range of 110° C. to 195° C. An example thereof is Dyneon THV® produced by 3M, Japan. Furthermore, a thermal pellet incorporated thermal fuse with a high temperature range that has not conventionally been achieved can be produced as a commercially available product, including first of all PTFE allowing approximately 327° C., and PFA and FEP allowing approximately 305° C. and approximately 270° C., respectively. Note that fluorine resin has an excellent chemical resistance and if it is used continuously, PTFE would endure 260° C., PFA would endure 260° C., and FEP would endure 200° C. As such, a thermal fuse using a thermal pellet of the resin exhibits more significant thermal stability than a mold of powder using a chemical agent as conventional.

The present temperature setting method adjusts heat distortion temperature by a polymer blend, a polymer alloy or the like of two or more types of high molecular weight substances. It is selected from the materials listed in Tables 1 and 2 and also has its blending ratio (or monomer ratio) varied. Herein, EVAL®, a representative brand of EVOH, produced by KURARAY CO., LTD., will be used for description. EVOH is an ethylene vinyl alcohol copolymer resin and by modifying this polymer's ethylene content a grade having a different melting point can be provided. F101 having an ethylene content of 32 mol % has a melting point of 183° C. E105 having an ethylene content of 44 mol % has a melting point of 165° C. G156 having an ethylene content of 47 mol % provides a melting point of 160° C. This is not done to vary a melting point. Rather, it is done to provide an improved gas barrier, improved workability and the like, as EVOH is required to. Furthermore in accordance with the present invention, adjusting the heat distortion temperature is also possible by changing the degree of polymerization. The degree of polymerization is changed by varying a molecular weight distribution and thereby providing variation in average molecular weight. Accordingly the obtained crystalline thermoplastic resin will vary in density. As a result a thermal pellet having an identical composition and nonetheless allowing a different operating temperature can be controlled by the density. Hereinafter, polyethylene (PE) will be used as an example for description. PE is classified depending on density and has a melting point clarified by density.

LDPE: density: 0.910 to 0.935, melting point: 105 to 110° C.

HDPE: density: 0.941 to 0.965 melting point: 130 to 135° C.

Furthermore, other than this PE, there are LLDPE having a melting point at 120 to 130° C., ultra high molecular weight PE having a melting point at 135 to 138° C., and the like, and for identical material, temperature conversion is possible from density. However, heat distortion temperature can be selected as adjusted not only by the degree of polymerization but also by mixing LDPE and HDPE or LLDPE or the like. Furthermore, plasticizer can also be added to crystalline high molecular substance, thermoplastic resin or the like to decrease heat distortion temperature.

In accordance with the present invention a crystalline, high molecular weight substance can have a secondary material for resin added thereto, as required. The secondary material can be classified generally into an additive, a reinforcement material, and a filler. The additive generally includes an antioxidant, a thermostabilizer, a photostabilizer, a nucleus creator, a compatibilizer, a colorant, an antimicrobial agent, an antifungal agent, a lubricant, and a foaming agent. Of these, important to a thermal fuse are the antioxidant and the thermostabilizer to exhibit thermal stability at high temperature, the nucleus creator to provide an increased degree of crystallinity to make use of crystalline resin's feature, and the colorant as it is effective in identifying a temperature range.

The reinforcement material includes mica, calcium carbonate, glass fiber, carbon fiber, aramid fiber and the like, and this can be added for example when copolymerization, elastomer-blending, or the like results in a thermal pellet softened more than required and/or the pellet's physical dimension needs to be maintained at high temperature. The filler includes talc, clay, calcium carbonate and similar extender, and flame retarder, an antistatic agent, plasticizer and the like. The extender is introduced into the resin to minimize the cost for resin material. The flame retarder is introduced to help the resin to be less burnable. The antistatic agent is introduced to prevent the resin from storing electricity.

Furthermore, the thermal pellet's physical dimension can also be utilized to adjust heat distortion temperature. For example, the pellet may have a filler or the like added thereto; the pellet may be varied in size or geometry; the pellet and the spring may have arranged therebetween a plate modified as appropriate. The pellet's physical dimension can thus be varied and mechanical strength can be adjusted to vary heat distortion temperature.

In the present invention in another aspect the thermal pellet is used as selected in accordance with a reduction in mass ratio depending on deliquescence to avoid the effect of the deliquescent property that the pellet by itself has. For example, it is so selected that after it has been immersed in water of 23° C. for 24 hours it provides a mass reduction ratio of equal to or less than 5% by mass. Preferably, a pellet is selected that provides a mass reduction ratio of equal to or less than 1% by mass after the pellet has alone been immersed in water of 23° C. for 24 hours. This means selecting a pellet insoluble in water for a thermal pellet for a thermal fuse. If a thermal pellet formed of thermosensitive material soluble in water is incorporated into a thermal fuse, the fuse may operate and break or fail in storage or use before abnormal temperature is reached, or the material reacts with water and may be modified. Either case should be avoided as it causes a defect in the thermal fuse.

On the other hand, the present thermal pellet incorporated thermal fuse employs a thermal pellet selected in accordance with a mass reduction ratio depending on sublimation to avoid the effect of sublimation of the pellet by itself. More specifically, preferably, the pellet is alone subjected to thermogravimetric analysis (TG), heated at a prescribed temperature rate to a prescribed temperature, and a mass reduction ratio obtained thereafter is considered for selection and use. For example, a pellet is preferably selected and used that provides a mass reduction ratio of at most 5% by mass, preferably at most 1% by mass when it is heated at a temperature rate of at least 5° C./min. to an operating temperature. This is a method employed to prevent a defect attributed to sublimation. This can prevent use of readily sublimatable material and help to select less sublimatable material to prevent a thermal fuse from interruption/disconnection at a temperature other than abnormal temperature, and also serve an important index in increasing insulation resistance and improving dielectric strength. Furthermore the present invention preferably uses a thermal pellet providing a mass reduction ratio of at most 1% by mass at a temperature higher than an operating temperature by at least 50° C. when the pellet is alone subjected to thermogravimetric analysis (TG). Smaller mass reduction ratios indicate that the thermal pellet is superior. In particular, it is used as an index indicating that mass reduction attributed to sublimation hardly occurs. This is important for a thermal fuse in that it prevents disconnection/interruption attributed to reduced volume, mass and the like while the thermal fuse is being used, and it also affects insulation after operation, an important function of the thermal fuse. For example, if in storage or use the pellet sublimates and thus adheres in a vicinity of the contact, it invites reduced insulation resistance and causes abnormal operation. Accordingly to form a thermal pellet a material needs to be selected that is higher in volume specific resistance in solid state and also less sublimatable.

As such the present thermal pellet incorporated thermal fuse preferably uses a thermal pellet allowing at least 0.2 MΩ in insulation resistance at least for one minute at a temperature higher than an operating temperature. For example, a thermal pellet is preferable that provides a mass reduction ratio of at most 5% by mass depending on the deliquescent property of the pellet by itself and a mass reduction ratio of at most 5% by mass at an operating temperature depending on the sublimative property of the pellet, and also allows a thermal fuse with the selected thermal pellet incorporating therein to provide an insulation resistance value of 0.2 MΩ at least for one minute, as measured at a temperature higher than its operating temperature by at least 50° C. This satisfies the UL 1020 standard. More preferable is a thermal fuse structured as described above that incorporates a thermal pellet allowing an insulation resistance value of at least 0.2 MΩ at least for one minute, as measured after operation at a temperature 100° C. higher than its operating temperature. Furthermore, a thermal fuse structured as described above is suitable that incorporates a thermal pellet allowing an insulation resistance value of at least 0.2 MΩ for at least one minute, as measured at 350° C., preferably 400° C. after operation.

The present invention in still another aspect notes a geometrical structure of a thermal pellet used in a thermal pellet incorporated thermal fuse to propose a method to achieve improved response. Typically a pellet has a columnar geometry. However, if necessary, it preferably is a column having a cavity therein or a surface provided with a recess, and furthermore molded into a hollowed pipe. Such a geometry allows a thermal pellet incorporated thermal fuse to operate with an increased response speed and hence with high precision and greater reliability.

In accordance with the present invention a thermal pellet is produced by a method using thermosensitive resin of a high molecular weight compound and a copolymer thereof. This can help to granulate powder and mold it into a pellet, as conventional, and in addition thereto injection mold or extrusion mold a melted resin material in a desired geometry. For example, material is extrusion molded and cut by a required length to form a thermal pellet, or a sheet member having the same thickness as the height of a thermal pellet is directly punched and thus molded to produce a pellet having a desired geometry. As such, complicated geometries can also be readily achieved by extrusion molding. If a simple, substantially columnar geometry is desired or the columnar geometry is provided with a hole to provide a substantial pipe, extrusion molding or sheet punching is sufficient. Furthermore, the present thermal pellet can also be produced by re-fusion molding. Any of the approaches can facilitate production at low cost. In particular, if an inexpensive and frequently used method is desired, extrusion molding can be selected, and for material without injection grade, another technique is adapted so that a method of production and a material can be selected from a wider range.

The thermal pellet can be formed of two or more different types of thermosensitive resin portions at least one of which is employed to adjust an operating temperature and the other, at least one of which covers a portion or the entirety of the thermoplastic resin contributing to the operating temperature. By 2-color molding or depositing in layers in the form of a sheet, a thermal pellet using two or more different types of thermosensitive resin can be readily molded, and if there are concerns such as gas barrier property, hygroscopicity, and hazard by copper, then the thermal pellet can have its surface partially or entirely covered with a protection layer to provide the pellet with improved characteristics. While melted material is thus used to obtain a thermal pellet as intended, compacting powder, as conventional, is also considered if thermal history is considered as an issue or a material having a melting point and a thermal decomposition temperature close to each other is used. Furthermore, after the thermal pellet is molded, the pellet can be annealed to adjust the degree of crystallinity.

EXAMPLE 1

Figure 2:
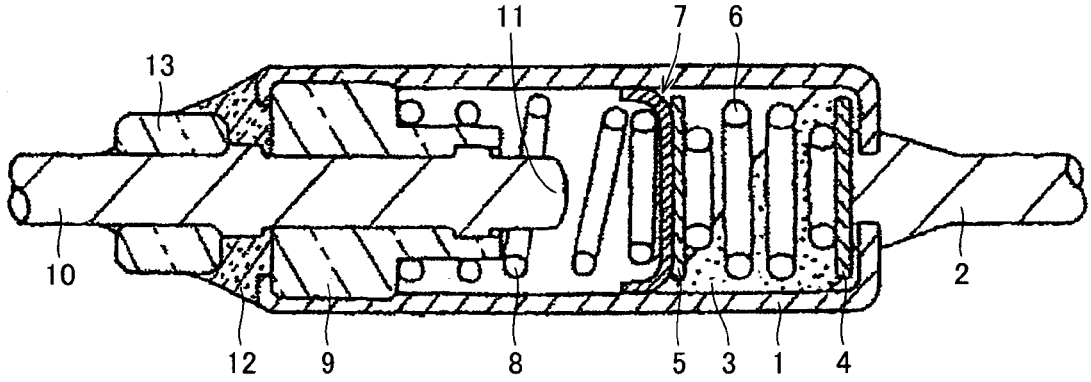
FIG. 2 is a cross section of the present thermal pellet incorporated thermal fuse after operation.

FIGS. 1 and 2 each show a cross section of a thermal pellet incorporated thermal fuse of the present embodiment. FIG. 1 is a cross section thereof at normal time at normal temperature and FIG. 2 is a cross section thereof in operation when it experiences abnormal heat. This configuration is similar in basic structure to a thermal pellet incorporated thermal fuse SEFUSE® produced by NEC SCHOTT Components Corporation except for material used for thermosensitive material. A cylindrical enclosure 1 is a casing formed of copper, yellow copper or similar satisfactorily heat conductive metal and having one opening with a first lead member 2 crimped and thus fixed thereto. Metal casing 1 accommodates a thermal pellet 3, a feature of the present invention, together with a component functioning as a switch including a pair of pressure plates 4 and 5, a spring member including strong and weak compression springs 6 and 8, and a movable conductive member 7 formed of silver alloy satisfactorily conductive and having an appropriate level of elasticity. Enclosure 1 has the other opening receiving an insulating bushing 9, and a second lead member 10 penetrates bushing 9 and is insulated from enclosure 1, and has an end provided with a fix electrode 11, and a hermetic seal is then provided. For the enclosure 1 other opening, epoxy resin or similar sealing resin 12 is used and cooperates with an insulated bushing 13, which covers the second lead member 10, to fix the second lead member 10. Herein, for thermal pellet 3, a feature of the present invention, a method of setting a temperature is applied employing a thermoplastic resin having any heat distortion temperature as a main material, and molding it to provide a desired, adjusted operating temperature, and the method selects and uses a material thermally deforming at a temperature at which the thermal fuse operates. FIG. 1 shows a thermal pellet incorporated thermal fuse at normal temperature when the first and second lead members 2 and 10 conduct, and FIG. 2 shows the fuse at an abnormal temperature exceeding its operating temperature, having the lead members disconnected.

Thermal pellet 3 is alone subjected to a test comparing it between nine types of thermoplastic resin in accordance with the present invention and a thermosensitive material used for a conventional product for evaluation specifically for deliquescence, sublimation, and mechanical strength, as indicated in Tables 3 and 4 by "O" (pass) or "X" (fail). Mechanical strength is indicated in Table 5 as occurrence of cracking/chipping. The nine types of thermoplastic resin employed in the present invention each have a name (as classified), a commercial name (or a product name), a grade and its manufacturer, and a specification as cataloged as follows:

1. LDPE (trade name: J REX LDPE-JM910N produced by Japan Polyolefin Co., Ltd. Melting point as cataloged: 108° C.)
2. LLDPE (trade name: J REX LLDPE-AM830A produced by Japan Polyolefin Co., Ltd. Melting point as cataloged: 122° C.)
3. POM (trade name: Iupital F20-54 produced by Mitsubishi Engineering-Plastics Corporation. Melting point as cataloged: 166° C.)
4. PP (trade name: Grand Polypro J557F produced by Grand Polymer Co., Ltd. Melting point as cataloged: 170° C.)
5. HDPE (trade name: Hizex HDPE-1300J produced by Mitsui Chemicals, Inc. Melting point as cataloged: 1134° C.)
6. PMP (trade name: TPX-RT18 produced by Mitsui Chemicals, Inc. Melting point as cataloged: 237° C.)
7. FEP (trade-name: Neoflon NP-101 produced by Daikin Industries, Ltd. Melting point as cataloged: 270° C.)
8. PBT (trade name: Valox 310 produced by GE Plastics Japan Ltd. Melting point as cataloged: 227° C.)
9. RET (ternary copolymer of ethylene, acrylic ester, and acid anhydride monomer. trade name: Rex Pearl ET182 produced by Japan Polyolefin Co., Ltd. Melting point as cataloged: 99° C.).

Evaluation of Deliquescence

A thermosensitive pellet is alone subjected to a test comparing it between the nine types of thermoplastic resin used in the present invention and a thermosensitive material used in a conventional product for evaluation of an issue associated with deliquescence, as shown in Table 3. A defect associated with thermosensitive material's deliquescence depends on moisture, and its effect is compared and studied by the pellet's mass reduction ratio The test is performed as follows: a thermal pellet having its mass previously measured is immersed in water of 23° C. for 24 hours and then dried at room temperature and thereafter has its mass measured and compared with that of the pellet measured before it is immersed in the water to obtain a mass reduction ratio. The mass reduction ratio is divided into: 5% by mass or more; less than 5% by mass to 1% by mass or more; less than 1% by mass; and deliquescence unobservable to determine pass/fail. Tested are pellets formed of the nine types of thermoplastic resin used in the present inventions and three types employed as thermosensitive materials for conventional products.

TABLE 3

| Thermosensitive Material | Product Name (Grade) | Maker Or The Like | x: Mass Reduction Ratio (%) | | | |
|---|---|---|---|---|---|---|
| | | | x > 5 | 1 < x ≦ 5 | 0 < x ≦ 1 | None |
| low density polyethylene | J REX (JM910N) | Japan Polyolefin | ○ | ○ | ○ | ○ |
| polyacetal | Iupital (F20-54) | Mitsubishi Engineering Plastics | ○ | ○ | ○ | ○ |
| polypropylene | Grand Polypro (J557F) | Grand Polymer | ○ | ○ | ○ | ○ |
| polyethylene-vinyl alcohol | Soarnol (F101B) | The Nippon Synthetic Chemical Industry Co., Ltd. | ○ | ○ | ○ | ○ |
| polymethylpentene | TPX (RT18) | Mitsui Chemicals | ○ | ○ | ○ | ○ |
| poly vinylidene fluoride | Neoflon (VP-825) | Daikin Industries, Ltd | ○ | ○ | ○ | ○ |
| polytetrafluoroethylene-propylene hexafluoride | Neoflon (NP-101) | Daikin Industries, Ltd | ○ | ○ | ○ | ○ |
| polybutylene terephthalate | Valox (310) | GE Plastics Japan Ltd. | ○ | ○ | ○ | ○ |
| polyethylene terephthalate | Rynite (FR530) | Dupont | ○ | ○ | ○ | ○ |
| polyphenylene sulfide | Idemitsu PPS | Idemitsu Kosan Co. Ltd. | ○ | ○ | ○ | ○ |
| polyamide 6 | Ultramid (B3EG6) | BASF Japan | ○ | ○ | ○ | ○ |
| RET *1 | Rex Pearl ET (ET182) | Japan Polyolefin | ○ | ○ | ○ | ○ |
| exemplary conventional 110° C. product | resorcin | Japanese Utility Model Laying-open No. 6-12594 | ○ | X | X | X |
| exemplary conventional 113° C. product | 3,5-dimethylpyrazole | Japanese Patent Laying-Open No. 2002-163966 | X | X | X | X |
| exemplary conventional 192° C. product | 4-methylumbelliferone | Japanese Patent Laying-Open No. 60-138819 | ○ | ○ | X | X |

*1: representing ternary copolymer of ethylene-acrylic ester-acid anhydride monomer As is apparent from Table 3, a conventional 192° C. product provides a reduction in mass of 1% by mass or less. A conventional 110° C. product provides a reduction in mass in a range of 1-5% by mass. Furthermore, a conventional 113° C. product provides a reduction in mass of 5% by mass or more. In particular, resorcin, a material used for a conventional pellet, has a high possibility of disconnection attributed to deliquescence for high humidity despite that the material itself has a high specific resistance value. For the present invention's products, deliquescence is not observed for any of the nine types of material (or grades). Thus, as compared with the conventional products, the present invention's products have a significant difference and are evaluated as improved products against deliquescence. The present invention's products are evaluated as less prone to disconnection at high humidity.

Evaluation of Sublimation

Table 4 indicates evaluation of sublimation. A defect associated with sublimation of thermosensitive material occurs more readily at high temperature. Herein to evaluate a thermal pellet's sublimative property the pellet is exposed to high temperature and thus evaluated by its mass reduction ratio. The test is conducted with samples identical to those used for evaluation of deliquescence, i.e., the nine types of products of the present invention and the three types of conventional products, by using TGA-50 produced by Shimadzu Corporation and subjecting the pellet alone to thermogravimetric analysis (TG) with temperature increased at a rate of 10° C./min., and nitrogen gas having a flow rate of 10 cc/min. Each pellet is alone measured and determined for a mass reduction ratio of 5% by mass or less at the operating temperature, a mass reduction ratio of 1% by mass or less at the operating temperature, and a mass reduction ratio of 1% by mass or less at the operating temperature plus 50° C. This evaluation is made with reference to a mass reduction ratio provided by a reduction in mass relative to an initial mass, as represented in % by mass.

TABLE 4

| Thermosensitive Material | Product Name (Grade) | Mass Reduction Ratio | | |
|---|---|---|---|---|
| | | Operating Temp. | | Operating Temp. + 50° C. |
| | | At Most 5% | At Most 1% | At Most 1% |
| low density polyethylene | J REX (JM910N) | ○ | ○ | ○ |
| polyacetal | Iupital (F20-54) | ○ | ○ | ○ |
| polypropylene | Grand Polypro (J557F) | ○ | ○ | ○ |
| polyethylene-vinyl alcohol | Soarnol (F101B) | ○ | ○ | ○ |
| polymethylpentene | TPX (RT18) | ○ | ○ | ○ |
| poly vinylidene fluoride | Neoflon (VP-825) | ○ | ○ | ○ |
| polytetrafluoroethylene-propylene hexafluoride | Neoflon (NP-101) | ○ | ○ | ○ |
| polybutylene terephthalate | Valox (310) | ○ | ○ | ○ |

TABLE 4-continued

| Thermosensitive Material | Product Name (Grade) | Mass Reduction Ratio | | |
|---|---|---|---|---|
| | | Operating Temp. | | Operating Temp. + 50° C. |
| | | At Most 5% | At Most 1% | At Most 1% |
| polyethylene terephthalate | Rynite (FR530) | ○ | ○ | ○ |
| polyphenylene sulfide | Idemitsu PPS | ○ | ○ | ○ |
| polyamide 6 | Ultramid (B3EG6) | ○ | ○ | ○ |
| RET *1 | Rex Pearl ET (ET182) | ○ | ○ | ○ |
| exemplary conventional 110° C. | resorcin | ○ | ○ | X 6.8 |
| exemplary conventional 113° C. product | 3,5-dimethylpyrazole | X (6.21) | X 6.21 | X (96.0) |
| exemplary conventional 192° C. product | 4-methylumbelliferone | ○ | ○ | X 1.7 |

Figure 4:
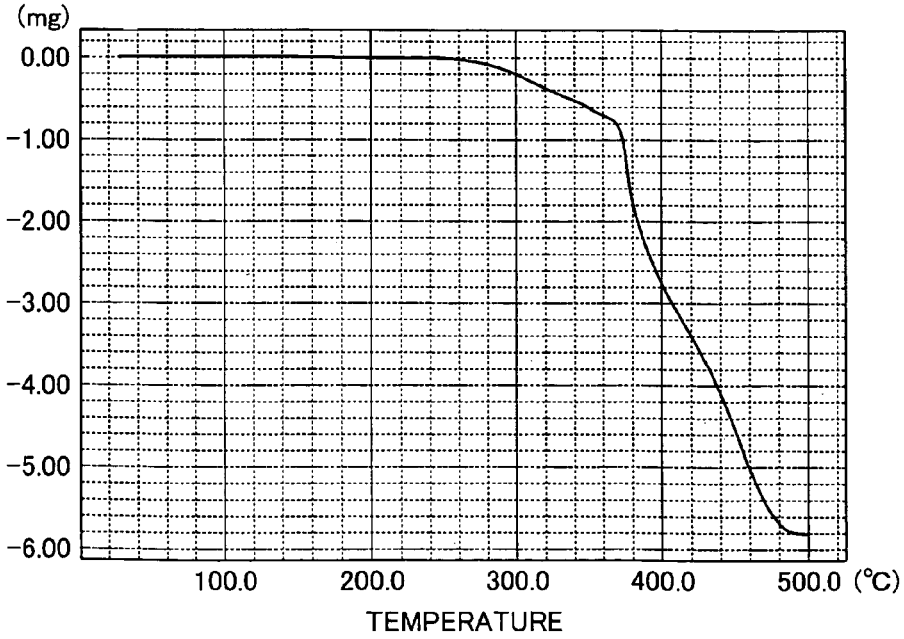
FIG. 4 represents a characteristic of sublimation of a thermoplastic resin employed for a thermal pellet of the present thermal fuse.
Figure 10:
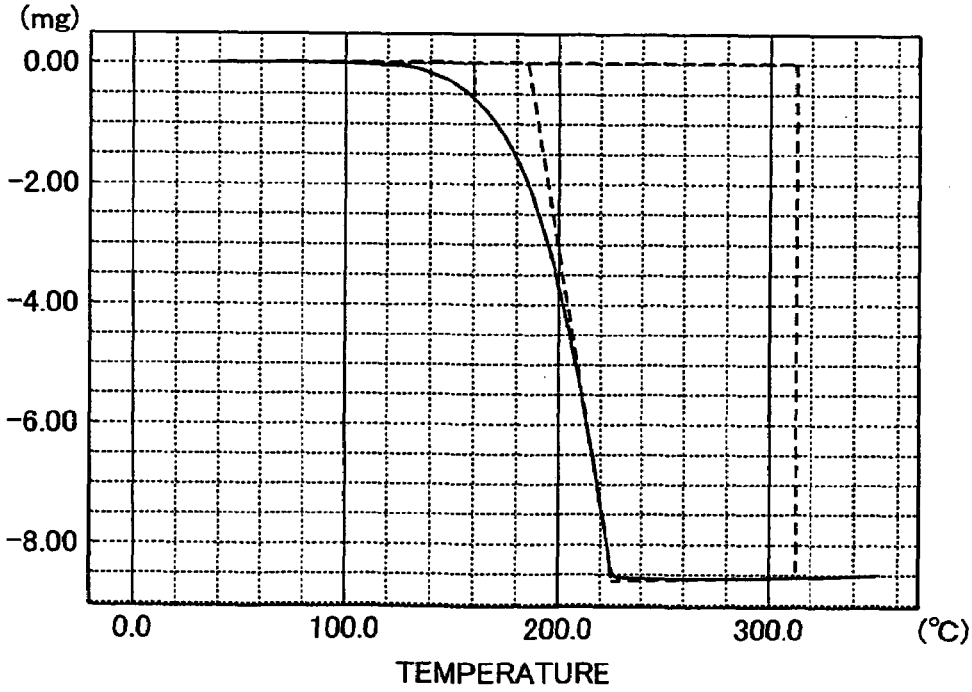
FIG.10 PRIOR ART
FIG. 10 represents a characteristic of sublimation of a thermosensitive material used for a thermal pellet for a conventional thermal pellet incorporated thermal fuse.

Numerical values in parentheses indicate actual mass reduction values.
*1: representing ternary copolymer of ethylene-acrylic ester-acid anhydride monomer As is apparent from Table 4, at the operating temperature, the conventional 110° C. and 192° C. products provide a mass reduction ratio of 1% by mass or less, whereas the conventional 113° C. product provides a mass reduction ratio of 6.21% by mass. Furthermore, at the operating temperature plus 50° C., the three conventional products all provide a reduction in mass of 1% by mass or more. By contrast, the present invention's products provide a mass reduction ratio of 1% by mass or less for all of the types and measurement ranges. FIGS. 4 and 10 represent sublimation characteristics indicating temperature (° C.) and sublimation (mg) by a thermogravimetric analyzer. FIG. 4 represents a characteristic curve of the present invention's product (Rex Pearl (RET), operating at 101° C.). FIG. 10 represents a characteristic curve of a conventional product (resorcin, operating at 110° C.).

Evaluation of Mechanical Strength

Another concern of a thermal pellet to be addressed is cracking, chipping and the like introduced in particular before assembly by vibration, falling, and contact between pellets and the like. Thermal pellets formed of the nine types used in the present invention and the conventional, three types of products are used, 100 pieces for each. They are dropped from one meter above the ground and compared for how many of them cracks and/or chips. They are dropped repeatedly ten times. Table 5 shows a result thereof. As is apparent from the result, the conventional three types of products each have more than half thereof cracked and/or chipped, whereas the present invention's products provide an occurrence of 0%. This reveals that the present thermal pellet is an improved pellet that has increased mechanical strength and hardly cracks or chips.

TABLE 5

| Thermosensitive Material | Product Name (Grade) | Rate Of Occurrence Of Cracking/Chipping (%) |
|---|---|---|
| low density polyethylene | J REX (JM910N) | 0 |
| polyacetal | Iupital (F20-54) | 0 |
| polypropylene | Grand Polypro (J557F) | 0 |
| polyethylene-vinyl alcohol | Soarnol (F101B) | 0 |
| polymethylpentene | TPX (RT18) | 0 |
| poly vinylidene fluoride | Neoflon (VP-825) | 0 |
| polytetrafluoroethylene-propylene hexafluoride | Neoflon (NP-101) | 0 |
| polybutylene terephthalate | Valox 310 | 0 |
| polyethylene terephthalate | Rynite (FR530) | 0 |
| polyphenylene sulfide | Idemitsu PPS | 0 |
| polyamide 6 | Ultramid (B3EG6) | 0 |
| RET *1 | Rex Pearl ET (ET182) | 0 |
| exemplary conventional 110° C. product | resorcin | 5 |
| exemplary conventional 113° C. product | 3,5-dimethylpyrazole | 7 |
| exemplary conventional 192° C. product | 4-methylumbelliferone | 6 |

*1: representing ternary copolymer of ethylene-acrylic ester-acid anhydride monomer

EXAMPLE 2

Figure 3A:
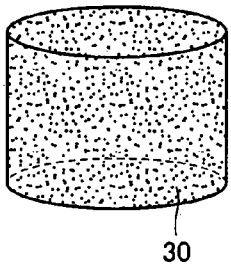
FIGS. 3A-3F are each a perspective view of a thermal pellet used in the present thermal fuse.
Figure 3B:
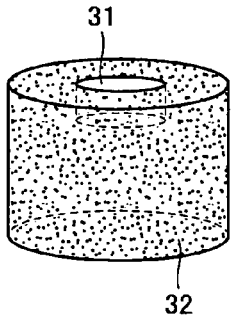
Figure 3C:
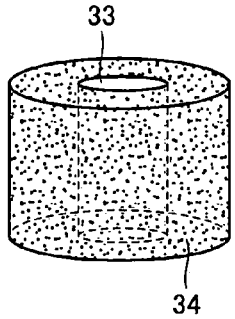

An experiment is conducted on exemplary variations in geometry of thermal pellet 3 of the FIG. 1 thermal pellet incorporated thermal fuse, and for examining their functions and effects. Thermal pellet 3 typically has a substantially columnar structure, and a variety of exemplary variations thereof, as shown in FIG. 3, are evaluated. In accordance with the present invention, heat distortion temperature is set by a method including a method setting a special geometry, and this method is effective in adjusting an operating temperature as desired. FIG. 3 shows thermal pellets having six different geometries. FIG. 3A shows a general purpose, substantially columnar pellet 30. A substantial column can satisfactorily be incorporated in comparison with a quadrangular prism, and by modifying the column in length and diameter an operating temperature can be set as desired. FIG. 3B shows a pellet 32 provided with a recess 31. FIG. 3C shows a pellet 34 hollowed or provided with a cavity 33 to substantially have the form of a pipe. Pellets 32 and 34 each have an external geometry dimensioned to set an operating temperature similar to that of pellet 30. Recess 31 and cavity 33 are effective if faster response speed is desired, as described in Example 5. In addition to such geometries, a pellet can be sized or the like to set a temperature by a method modifying an external dimension to adjust heat distortion temperature. As long as it does not depart from the present invention's concept, it is not limited to a substantial column and may be a variety of external geometrical dimensions, such as a substantial octagon or hexagon. In particular, an extrusion mold that does not involve a die to provide dimension or geometry has deformation in its cross section. These are included in the present method of setting an operating temperature, however, if precision of operation at a desired operating temperature is ensured.

Figure 3D:
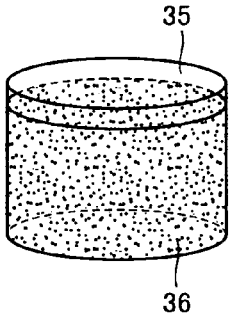
Figure 3E:
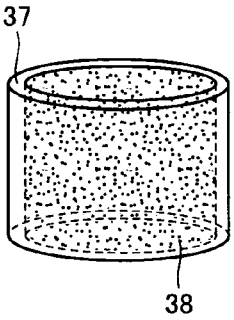
Figure 3F:
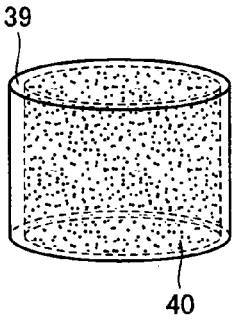

FIGS. 3D, 3E and 3F show by way of example thermal pellets formed of different thermoplastic resin portions. FIGS. 3D and 3E show thermal pellets 36 and 38 contributing to an operating temperature and having a surface partially provided with different thermoplastic resins 35 and 37, respectively, by way of example. FIG. 3F shows a thermal pellet 40 contributing to an operating temperature, having an entire surface covered with a thermoplastic resin 39 different from thermal pellet 40. The FIG. 3D pellet can be obtained for example by punching a sheet formed of a stack of layers. Thermoplastic resin 36 can be affected by metal, copper in particular, if pressure plate 4 is formed of copper. The above structure is useful in that layer 35 is interposed for protection to prevent the metal from affecting thermal pellet 36. FIG. 3E shows a pellet having a side surface provided with a layer for protection 37. This can be readily obtained for example by extrusion molding. This structure is effective when an adjacent metal's effect is a concern, or when highly hygroscopic material such as PA is protected by a layer formed of a less hygroscopic material such as PET or similar polyester based material. FIG. 3F shows thermal pellet 40 entirely covered with a layer for protection 39 formed of a material different from thermal pellet 40. This can be readily obtained for example by injection molding or the like. This structure, as well as FIGS. 3D and 3E, effectively protects a thermal pellet from degradation of resin attributed to metal, hygroscopicity and the like. In particular, while the FIG. 3E structure arranges a protection a layer only on a side surface and thus provides a limited antihygroscopic or similar effect, the FIG. 3F structure covers the pellet entirely and thus provides a more significant antihygroscopic or similar effect.

EXAMPLE 3

Thermoplastic resin employed in the present embodiment is used to form thermal pellet 3 to fabricate the FIG. 1 thermal pellet incorporated thermal fuse, and the fuse's operating temperature and variation (precision of operation: R) are indicated in Table 6. Furthermore, Table 7 indicates an insulation resistance value as an electrical characteristic for high temperatures of 350° C. and 400° C. In Table 7, "O" indicates an insulation resistance value of at least 0.2 MΩ at least for one minute and "X" indicates an insulation resistance value of less than 0.2 MΩ within one minute.

TABLE 6 unit (° C.)

| | Thermal Fuse Incorporating The Present Thermal Pellet | | | | | | | | | Conventional Products | | |
|---|---|---|---|---|---|---|---|---|---|---|---|---|
| No. | RET ET182 | LDPE JM910N | LLDPE AM830A | HDPE 1300J | POM F20-54 | PP J557F | PBT 310 | PMP RT18 | FEP NP-101 | Product Operating At 110° C. resorcin | Product Operating At 113° C. 3,5-dimethyl pyrazole | Product Operating At 192° C. 4-methyl umbelliferone |
| 1 | 101.2 | 109.1 | 125.8 | 131.7 | 163.3 | 170.8 | 227.6 | 236.0 | 268.3 | 109.4 | 112.3 | 190.0 |
| 2 | 101.7 | 108.9 | 125.6 | 131.7 | 163.3 | 170.7 | 227.4 | 236.0 | 268.0 | 109.4 | 112.3 | 190.2 |
| 3 | 101.7 | 108.7 | 125.4 | 131.9 | 163.2 | 170.7 | 227.7 | 236.0 | 267.7 | 109.3 | 112.2 | 190.1 |
| 4 | 101.7 | 108.7 | 125.3 | 132.1 | 163.2 | 170.6 | 227.3 | 235.7 | 267.5 | 109.3 | 112.1 | 189.9 |
| 5 | 101.5 | 108.6 | 125.2 | 132.3 | 163.0 | 170.2 | 227.5 | 235.5 | 267.3 | 109.0 | 112.0 | 189.8 |
| Average Value | 101.6 | 108.8 | 125.5 | 131.9 | 163.2 | 170.6 | 227.5 | 235.8 | 267.8 | 109.3 | 112.2 | 190.0 |
| Standard Deviation | 0.2 | 0.2 | 0.2 | 0.3 | 0.1 | 0.2 | 0.2 | 0.2 | 0.4 | 0.2 | 0.1 | 0.2 |
| Max. | 101.7 | 109.1 | 125.8 | 132.3 | 163.3 | 170.8 | 227.7 | 236.0 | 268.3 | 109.4 | 112.3 | 190.2 |
| Min. | 101.2 | 108.6 | 125.2 | 131.7 | 163.0 | 170.2 | 227.3 | 235.5 | 267.3 | 109.0 | 112.0 | 189.8 |
| R | 0.5 | 0.5 | 0.6 | 0.6 | 0.3 | 0.6 | 0.4 | 0.5 | 1.0 | 0.4 | 0.3 | 0.4 |

RET: ternary copolymer of ethylene-acrylic ester-acid anhydride monomer
LDPE: low-density polyethylene
LLDPE: linear low-density polyethylene
HDPE: high-density polyethylene
POM: polyacetal
PP: polypropylene
PBT: polybutylene terephthalate
PMP: polymethylpentene
FEP: polytetrafluoroethylene-propylene hexafluoride

TABLE 7

| | Thermal Fuse Incorporating the Present Thermal Pellet | | | | | | | | | Conventional Products | | |
|---|---|---|---|---|---|---|---|---|---|---|---|---|
| Test Temp. | RET | LDPE | LLDPE | HDPE | POM | PP | PBT | PMP | FEP | Product Operating at 110° C. | Product Operating at 113° C. | Product Operating at 192° C. |
| Td + 50° C. | ○ | ○ | ○ | ○ | ○ | ○ | ○ | ○ | ○ | ○ | X | ○ |
| Td + 100° C. | ○ | ○ | ○ | ○ | ○ | ○ | ○ | ○ | ○ | X | X | ○ |
| 350° C. | ○ | ○ | ○ | ○ | ○ | ○ | ○ | ○ | ○ | X | X | X |
| 400° C. | ○ | ○ | ○ | ○ | ○ | ○ | ○ | ○ | ○ | X | X | X |

○: 0.2 MΩ (for 1 min.) OK
X: 0.2 MΩ (for 1 min.) NG
Td: operating temp. when incorporated in thermal fuse
RET: ternary copolymer of ethylene-acrylic ester-acid anhydride monomer
LDPE: low-density polyethylene
LLDPE: linear low-density polyethylene
HDPE: high-density polyethylene
POM: polyacetal
PP: polypropylene
PBT: polybutylene terephthalate
PMP: polymethylpentene
FEP: polytetrafluoroethylene-propylene hexafluoride As is apparent from Table 6, it has been revealed that the present thermal pellet is comparable at an operating temperature to a product using a conventional thermal pellet, allowing the fuse to operate with excellent precision and thus provide high reliability. Variation (R) has a range within 1° C., in contrast with that of ±2° C. or 4° C. as typically required, revealing that the present thermal fuse has sufficient precision of operation.

Furthermore, as is apparent from Table 7, a conventional product after operation provides a reduced insulation resistance value for an operating temperature (Td) plus 50° C., whereas the nine types used in the present invention after operation all provide an insulation resistance value of at least 0.2 MΩ even for the operating temperature (Td) plus 100° C., and for temperatures of 350° C. and 400° C. above the operating temperature an insulation resistance value of at least 0.2 MΩ is also confirmed. In particular, a thermal fuse incorporating a thermal pellet using fluorine resin FEP allowing a high operating temperature can be used in an application for high temperature range, implementing an operating temperature of approximately 268° C., which exceeds conventional product's maximum operating temperature, i.e., approximately 240° C. It has also been found that the fuse's insulation resistance value does not present a problem, as fluorine resin decomposes at a particularly high temperature, and if it is used continuously at increased temperature, it does not have significant degradation and also has an insulation resistance value larger than conventional thermal pellets.

EXAMPLE 4

A thermal pellet formed of copolymer is evaluated in connection with adjusting an operating temperature, as desired, including moisture resistance. The experiment is conducted using a thermosensitive material of ternary copolymer of ethylene, acrylic ester, and acid anhydride monomer (trade name: Rex Pearl ET). Rex Peael ET182 has a melting point of 99° C., as cataloged, and a density of 0.937. Rex Pearl ET184M has a melting point of 86° C., as cataloged, and a density of 0.945. By adjusting a monomer ratio a melting point can be adjusted, and they are each incorporated into a thermal fuse and its operating temperature is measured. As shown in Table 8, it has been found that although the thermal pellet incorporated thermal fuse tends to operate at a temperature slightly higher than the melting point of the pellet by itself, the temperature's variation (R) is small. For conventional chemical agents, variation (R) is indicated with a margin of approximately 4° C. depending on the reagent manufactures. Accordingly it has been found that if a thermal pellet's melting point and a thermal fuse's operating temperature can be correlated it can sufficiently be used as a thermal pellet incorporated thermal fuse.

TABLE 8 unit (° C.)

| No. | ET182 | ET184M |
|---|---|---|
| 1 | 101.2 | 90.3 |
| 2 | 101.7 | 90.1 |
| 3 | 101.7 | 90.1 |
| 4 | 101.7 | 89.9 |
| 5 | 101.5 | 89.8 |
| Average Value | 101.6 | 90.0 |
| Standard Deviation | 0.2 | 0.2 |
| Max. | 101.7 | 90.3 |
| Min. | 101.2 | 89.8 |
| R | 0.5 | 0.5 |

A thermal fuse incorporating a thermal pellet of Rex Pearl ET182 and operating at 101° C. is tested for moisture resistance. For comparison is used a conventional product (resorcin) providing an operating temperature (of 110° C.) higher than Rex Pearl ET182. The test was conducted at 85° C./95%, which is more severe than 65° C./95%, a condition for the test that is adopted by thermal fuse manufacturers. Each product's number of samples is 200 pieces. A result of the test is shown in Table 7. A thermal pellet's deliquescence can be indicated by its dimension. Accordingly, an initial value of 100% is set, and the thermal pellets are removed after a testing time set as desired, and their dimensions are measured to record how they vary. Furthermore their operating temperatures measured before and after storage and their variations (R) are shown in Table 9.

TABLE 9 unit (° C.)

| No. | ET182 Initial | ET182 After 5000 Hrs | Conventional Product (110° C.) Initial | Conventional Product (110° C.) After 1500 Hrs. |
|---|---|---|---|---|
| 1 | 101.2 | 101.3 | 109.4 | Break |
| 2 | 101.7 | 101.2 | 109.4 | Break |
| 3 | 101.7 | 101.2 | 109.3 | Break |
| 4 | 101.7 | 100.8 | 109.3 | Break |
| 5 | 101.5 | 101.3 | 109.0 | Break |
| Average Value | 101.6 | 101.2 | 109.3 | / |
| Standard Deviation | 0.2 | 0.2 | 0.2 | / |
| Max. | 101.7 | 101.3 | 109.4 | / |
| Min. | 101.2 | 100.8 | 109.0 | / |
| R | 0.5 | 0.5 | 0.4 | / |

It is apparent therefrom that a material readily dissolving in water in the form of a thermal pellet before it is incorporated in a thermal fuse, also deliquesces in the thermal fuse and reduces in strength, and after 1,500 hours, the thermal pellet incorporated thermal fuses using a conventional chemical reagent all break, whereas a thermal pellet formed of the present invention's thermoplastic resin (Rex Pearl ET182), and exposed to the same condition, exhibits a stable dimensional transition for a long period of time namely 5,000 hours. Although Rex Pearl ET182 also exhibits a tendency to reduce the pellet in dimension, this is a softening attributed to storage in a vicinity of its melting point, rather than deliquescence, as conventional. Furthermore a thermal pellet incorporated thermal fuse removed after 5,000 hours is tested to find that the fuse operates substantially at the same temperature as the initial value. It has been found that even though a thermal pellet providing a lower operating temperature than a conventional product is stored at the same temperature/humidity, it remains stable thermally, physically and with respect to humidity for a longer period of time than the conventional product. It has also been found that even resorcin, a material having a high volume specific resistance value, corresponding to a product operating at 110° C., is highly deliquescent for water and if it is incorporated in a thermal fuse and exposed to high humidity for a tong period of time there is a case where it breaks.

EXAMPLE 5

An elastomerized, crystalline thermoplastic resin is taken as an example to study adjustment of a melting point. The present example uses a thermoplastic polyether ester elastomer (product name: Hytrel® produced by Du Pont-Toray Co., Ltd.). Hytrel® is a PBT (having a melting point of 220 to 227° C.) and polyether block copolymer, and for that range of temperature, resins of 154° C. to 227° C. are available. In the present example it is incorporated as a thermal pellet in a thermal fuse according to FIG. 1 and the fuse's operating temperature and variation (R) are measured. The experiment was conducted with Hytrel® 3046 (melting point: 160° C.), 3546L (melting point: 154 C), 4047 (melting point: 182° C.) and 2751 (melting point: 227° C.), and PBT (melting point: 227° C., trade name: Valox®, produced by GE Plastics Japan Ltd.) for comparison. A result thereof is shown in Table 10.

TABLE 10 unit (° C.)

| No. | Hytrel 3046 | Hytrel 3546L | Hytrel 4047 | Hytrel 2751 | PBT |
|---|---|---|---|---|---|
| 1 | 170.7 | 161.0 | 184.8 | 226.2 | 227.6 |
| 2 | 170.4 | 160.7 | 185.2 | 226.1 | 227.4 |
| 3 | 169.9 | 160.4 | 185.3 | 225.5 | 227.7 |
| 4 | 169.5 | 160.4 | 185.4 | 225.1 | 227.3 |
| 5 | 169.5 | 160.4 | 185.4 | 225.7 | 227.5 |
| Average Value | 170.0 | 160.6 | 185.2 | 225.7 | 227.5 |
| Standard Deviation | 0.5 | 0.3 | 0.2 | 0.4 | 0.2 |
| Max. | 170.7 | 161.0 | 185.4 | 226.2 | 227.7 |
| Min. | 169.5 | 160.4 | 184.8 | 225.1 | 227.3 |
| R | 1.2 | 0.6 | 0.6 | 1.1 | 0.4 |

It is apparent from Table 10 that although between Hytrel's melting point and the fuse's operating temperature there is a slight difference, precision of operation has variations (R) all falling within ±1° C., which is not inferior in level to conventional art. Thus it has been verified that while PBT alone only allows an operating temperature of 227° C., PBT copolymerized or elastomerized allows adjustment of an operating temperature of a thermal fuse.

EXAMPLE 6

In the present example it is verified that by changing a thermal pellet in geometry, a thermal fuse having the thermal pellet incorporated therein can be varied in response speed. The thermal pellet is formed of LDPE (trade name: J Rex® LDPE-JM910N, produced by Japan Polyolefin Co., Ltd, having a melting point of 108° C., as cataloged). The two types of columnar (or unworked) product 30 as shown in FIG. 3A and product 34 having hole 33 in a vicinity of the center to have the form of a pipe as shown in FIG. 3C are used to conduct a test for comparison. The test was conducted by immersing a thermal pellet incorporated thermal fuse in an oil bath heated to be higher in temperature than the melting point to compare a period of time elapsing before the fuse operates.

Figure 8:
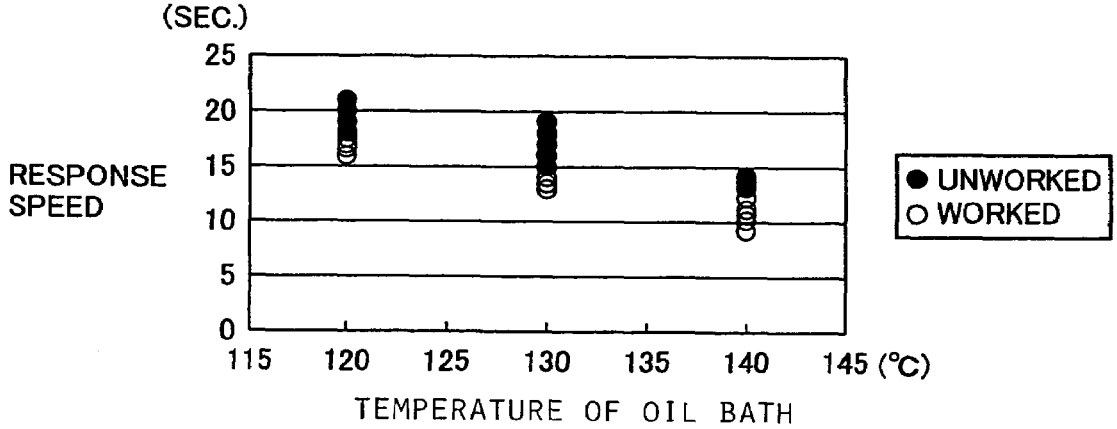
FIG. 8 represents a characteristic showing a difference in response speed depending on the presence/absence of a working e.g. forming process for a thermal pellet for the present thermal fuse.

FIG. 8 is a graph with the horizontal axis representing the oil bath's temperature and the vertical axis representing a time elapsing before a fuse operates. As is apparent from FIG. 8, it has been found that the fuse with the worked product 34 provides a faster response speed than with the unworked product 30. Conventionally, such a worked geometry is accompanied by a problem such as in mechanical strength, and in use it readily deforms at high temperature and high humidity and causes a break. As such, it has been difficult to introduce a structural modification. By contrast, the present invention allows stability in strength and can compound a reinforcement material as required, and such a thermal pellet as worked as described above is allowed. Note that a thermal pellet can be formed to have a geometry other than shown in FIG. 3C. For example, when mechanical strength is considered, a side surface or the like would accordingly be cut, recessed and/or the like to provide improved response.

EXAMPLE 7

In the present example it has been verified that heat distortion temperature can be adjusted by force exerted on a thermal pellet. ABS, an amorphous thermoplastic resin produced by Technopolymer Co., Ltd., is used as a thermosensitive material of a high molecular weight substance, and the dimensions thereof are considered in combination with a method of setting a temperature to conduct an experiment. The amorphous thermoplastic resin ABS has a softening point of 90° C. and this resin material is used to prepare two types of thermal pellets different in dimension. One pellet has a diameter ϕ of 3.2 mm and a height h of 3.0 mm and the other pellet has a diameter ϕ of 3.2 mm and a height h of 3.5 mm. In the present example a standard spring load is applied to conduct a test to examine an operating temperature. A result thereof is shown in Table 11. More specifically, it has been revealed that by fixing a diameter and changing a longitudinal dimension or length alone by 0.5 mm, an operating temperature can be adjusted by approximately 20° C. Furthermore from this result it has also been found that if an amorphous resin is used, an operating temperature has a variation (R) falling within ±1° C., and it is a material usable for a thermal fuse.

TABLE 11 unit (° C.)

| No. | Φ: 3.2 mm, h: 3.0 mm | Φ: 3.2 mm, h: 3.5 mm |
|---|---|---|
| 1 | 140.5 | 160.2 |
| 2 | 140.7 | 161.2 |
| 3 | 140.2 | 159.9 |
| 4 | 140.6 | 160.5 |
| 5 | 139.8 | 160.7 |
| Average Value | 140.4 | 160.5 |
| Standard Deviation | 0.4 | 0.5 |
| Max. | 140.7 | 161.2 |
| Min. | 139.8 | 159.9 |
| R | 0.9 | 1.3 |

Then a similar ABS produced by Technopolymer Co., Ltd. is used and it is verified that heat distortion temperature can be adjusted by a spring member's load. The above described columnar pellet having a diameter ϕ of 3.2 mm and a height h of 3.5 mm is used and it receives a force adjusted by a value of a load exerted by a spring of a spring member. The load value includes a standard load value, and the standard load value multiplied by 1.3 for comparison. An operating temperature and a variation (R) are indicated in Table 12.

TABLE 12 unit (° C.)

| No. | Load Value | Load Value × 1.3 |
|---|---|---|
| 1 | 160.2 | 151.3 |
| 2 | 161.2 | 150.7 |
| 3 | 159.9 | 150.8 |
| 4 | 160.5 | 151.5 |
| 5 | 160.7 | 151.2 |
| Average Value | 160.5 | 151.1 |
| Standard Deviation | 0.5 | 0.3 |
| Max. | 161.2 | 151.5 |
| Min. | 159.9 | 150.7 |
| R | 1.3 | 0.8 |

As is apparent from Table 12, it has been revealed that the standard load value multiplied by 1.3 can reduce an operating temperature by approximately 9° C. It is also apparent from the above result that using amorphous thermoplastic resin and combining it with an appropriate method of setting a temperature can provide precision of operation within ±1° C., which is smaller than ±2° C. to ±3° C. required for an existing thermal pellet and that there can be provided a thermal pellet incorporated thermal fuse having a comparable, excellent precision of operation. In this verification, weak compression spring 8 is modified. If strong compression spring 6 is modified a similar result would be obtained, and if they are combined together a similar result would be obtained.

EXAMPLE 8

In the present example, a thermal pellet formed of crystalline thermoplastic resin is subjected to experiment. In this example, Mitsui Polypro® Random PP produced by Mitsui Chemicals is used as a high molecular weight, crystalline thermoplastic resin. There are prepared a pellet having a diameter ϕ of 3.2 mm and a height h of 3.0 mm and a pellet having a diameter ϕ of 3.2 mm and a height h of 3.5 mm and the spring member exerts a load set to have a standard value. Table 13 shows a result of the test in connection with an operating temperature and variation (R). It is apparent from the results of Table 13 that it has been revealed that by fixing a diameter and changing a longitudinal dimension or length alone by 0.5 mm the operating temperature can be adjusted by approximately 6° C. Furthermore, the operating temperature has a variation (R) falling within ±1° C., indicating usability as a thermal fuse.

TABLE 13 unit (° C.)

| No. | Φ: 3.2 mm, h: 3.0 mm | Φ: 3.2 mm, h: 3.5 mm |
|---|---|---|
| 1 | 145.2 | 151.0 |
| 2 | 144.8 | 150.8 |
| 3 | 145.0 | 150.6 |
| 4 | 145.3 | 150.5 |
| 5 | 145.6 | 150.4 |
| Average Value | 145.2 | 150.7 |
| Standard Deviation | 0.3 | 0.2 |
| Max. | 145.6 | 151.0 |
| Min. | 144.8 | 150.4 |
| R | 0.8 | 0.6 |

Then similarly a thermal pellet formed of Mitsui Polypro® Random PP produced by Mitsui Chemicals is used and a temperature setting method is applied that adjusts the spring member's force to vary heat distortion temperature to verify that an actual operating temperature can be adjusted. The pellet has a diameter ϕ of 3.2 mm and a height h of 3.5 mm and a columnar geometry and receives a load having a standard value and that 1.3 times the standard load value. For the two different load values a thermal fuse incorporating the thermal pellet is measured and a result thereof is shown in Table 14. The spring load value is changed by incorporating a standard load value of weak compression spring 8 and the standard load value multiplied by 1.3.

TABLE 14 unit (° C.)

| No. | Standard Value | Standard Value × 1.3 |
|---|---|---|
| 1 | 151.0 | 147.8 |
| 2 | 150.8 | 147.5 |
| 3 | 150.6 | 147.5 |
| 4 | 150.5 | 147.4 |
| 5 | 150.4 | 147.4 |
| Average Value | 150.7 | 147.5 |
| Standard Deviation | 0.2 | 0.2 |
| Max. | 151.0 | 147.8 |
| Min. | 150.4 | 147.4 |
| R | 0.6 | 0.4 |

It has been found that the fuse with the thermal pellet receiving the standard load value operates approximately at 151° C., whereas that with the pellet receiving the standard load value multiplied by 1.3 operates approximately at 148° C. From this it can be confirmed that by adjusting a spring load value an operating temperature can be adjusted by approximately 3° C. It is apparent from these results that it has been found that a melting point specific to crystalline thermoplastic resin need not be considered and a value of a load exerted on a thermal pellet can simply be adjusted to set an operating temperature required for a thermal fuse and furthermore for the adjusted operating temperature a precision of operation within ±1° C. can be achieved, and the fuse has been found to have sufficient precision as a thermal fuse.

EXAMPLE 9

A present thermal pellet incorporated thermal fuse employs a high molecular weight, crystalline thermoplastic resin as a thermosensitive material and a heat distortion temperature thereof is set by a method utilizing a difference in temperature between an extrapolated initial melting temperature Tim and a peak melting temperature Tpm to conduct an experiment. For the thermal fuse according to FIG. 1, a thermal pellet formed of homo PP and random copolymerization PP of Mitsui Polypro® produced by Mitsui Chemicals and that using a conventional, low molecular weight, chemical agent for comparison (152° C. and 169° C. products) are used to conduct the experiment. Heat distortion temperature is adjusted by a method setting the spring member's weak compression spring 8 to exert a load having a standard value and a load having the standard value multiplied by 1.3. A differential scanning calorimeter (DSC) DCS-50 manufactured by Shimadzu Corporation is employed to measure these thermal pellets at 10° C./min. FIGS. 5, 6, 11 and 12 show a result thereof.

Figure 5:
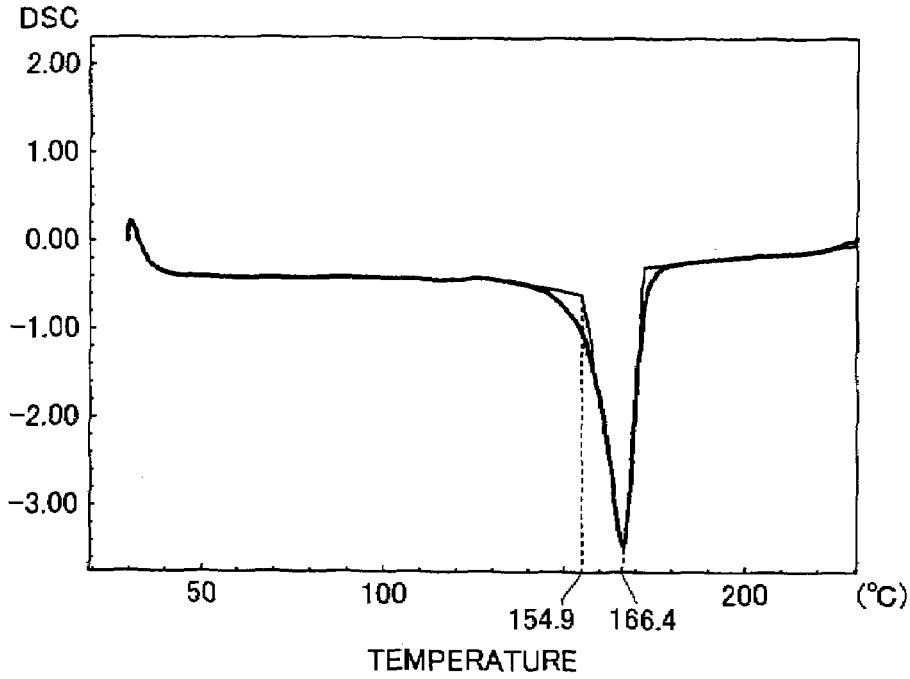
FIG. 5 represents a DSC characteristic curve in connection with homo PP used for a thermal pellet for the present fuse.

FIG. 5: Homo PP (produced by Mitsui Chemicals)

Figure 6:
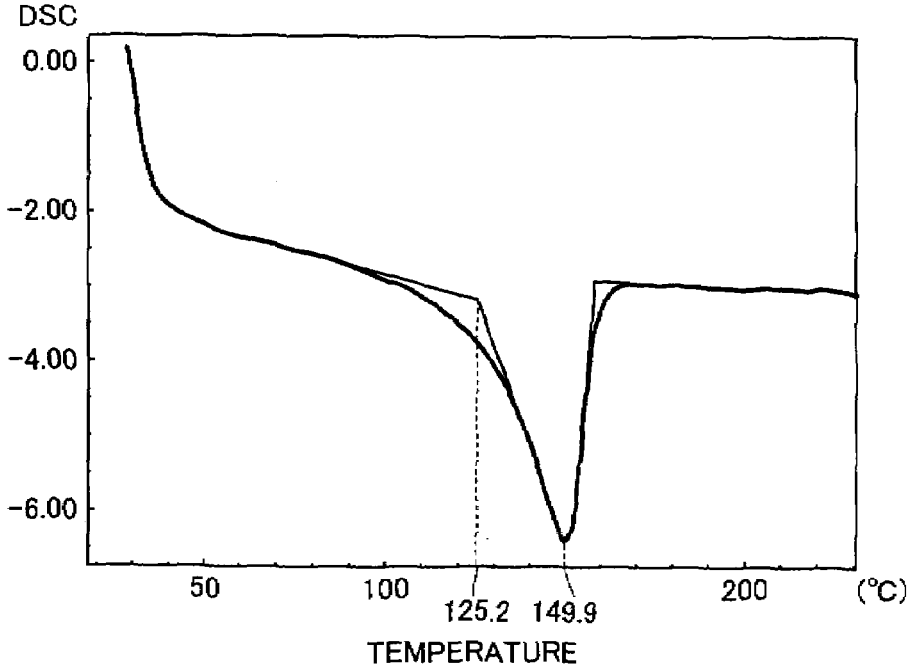
FIG. 6 represents a DSC characteristic curve in connection with a random copolymerization PP used for a thermal pellet for the present thermal fuse.
Figure 7:
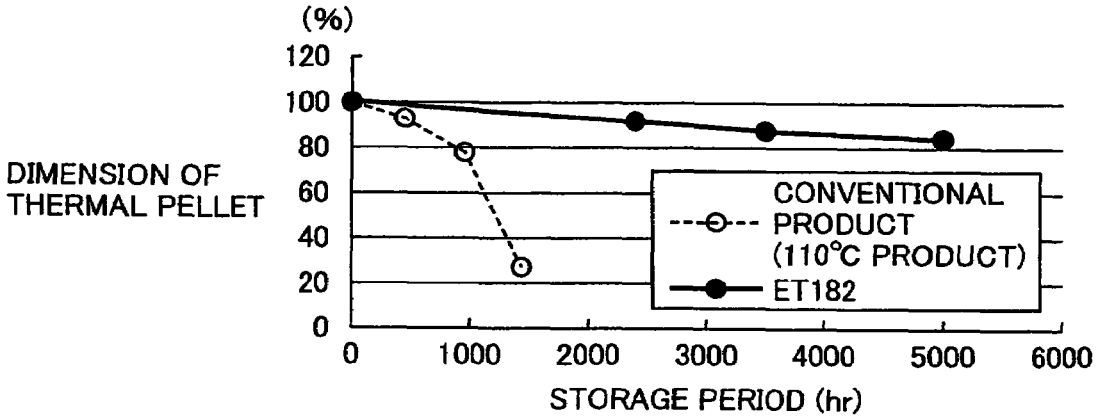
FIG. 7 represents a time variation of a thermal pellet of the present thermal fuse in storage.

FIG. 6: Random copolymerization PP (produced by Mitsui Chemicals)

Figure 11:
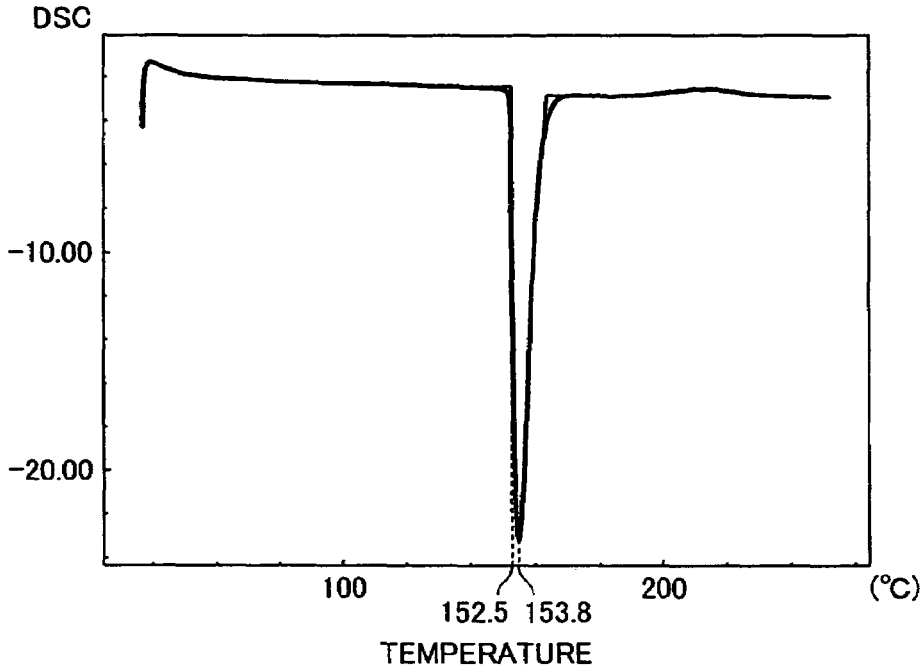
FIG.11 PRIOR ART
FIG. 11 represents a DSC characteristic curve in connection with a 152° C. thermosensitive material used for a thermal pellet for a conventional thermal pellet incorporated thermal fuse.

FIG. 11: 152° C. product (SEFUSE®)

Figure 12:
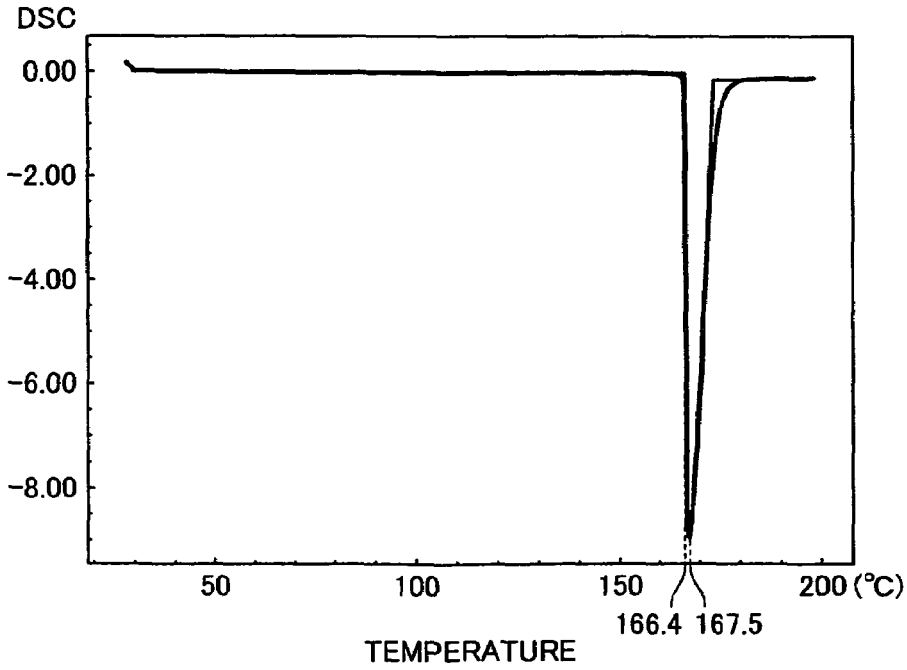
FIG.12 PRIOR ART
FIG. 12 represents a DSC characteristic curve in connection with a 169° C. thermosensitive material used for a thermal pellet for a conventional thermal pellet incorporated thermal fuse.

FIG. 12: 169° C. product (SEFUSE®)

From these results temperatures Tim and Tpm are obtained and therefrom a temperature difference Δ is calculated, as shown in Table 15, and Table 16 shows a result of measuring an operating temperature.

TABLE 15 unit (° C.)

| | Homo PP | Random Copolymerization PP | 152° C. Product | 169° C. Product |
|---|---|---|---|---|
| Tpm | 166.4 | 149.9 | 153.8 | 167.5 |
| Tim | 154.9 | 125.2 | 152.5 | 166.4 |
| ΔT | 11.5 | 24.7 | 1.3 | 1.1 |

TABLE 16 unit (° C.)

| | Homo PP | | Random Copolymerization PP | | 152° C. Product | | 169° C. Product | |
|---|---|---|---|---|---|---|---|---|
| No. | Standard | ×1.3 | Standard | ×1.3 | Standard | ×1.3 | Standard | ×1.3 |
| 1 | 166.5 | 164.1 | 152.2 | 147.5 | 152.7 | 152.3 | 169.1 | 168.5 |
| 2 | 166.5 | 163.8 | 152.0 | 147.5 | 152.5 | 152.2 | 168.8 | 168.5 |
| 3 | 166.4 | 163.8 | 151.8 | 147.4 | 152.4 | 152.2 | 168.7 | 168.4 |
| 4 | 166.4 | 163.6 | 151.7 | 147.3 | 152.3 | 152.1 | 168.7 | 168.2 |
| 5 | 166.2 | 163.5 | 151.6 | 147.2 | 152.3 | 152.1 | 168.6 | 167.8 |
| Average Value | 166.4 | 163.8 | 151.9 | 147.4 | 152.4 | 152.2 | 168.8 | 168.3 |
| Standard Deviation | 0.1 | 0.2 | 0.2 | 0.1 | 0.2 | 0.1 | 0.2 | 0.3 |
| Max. | 166.5 | 164.1 | 152.2 | 147.5 | 152.7 | 152.3 | 169.1 | 168.5 |
| Min. | 166.2 | 163.5 | 151.6 | 147.2 | 152.3 | 152.1 | 168.6 | 167.8 |
| R | 0.3 | 0.6 | 0.6 | 0.3 | 0.4 | 0.2 | 0.5 | 0.7 |

It is apparent from these results that it has been found that while the thermosensitive materials provide large temperature differences ΔT between temperatures Tim and Tpm, they are nonetheless equivalent in precision of operation (R) to the conventional products, and for larger ΔT it is more effective to apply the method of setting an operating temperature. While in the above description a temperature difference between Tim and Tpm is employed, an operating temperature can also be set by a method setting the temperature between peak melting temperature (Tpm) and extrapolated ending melting temperature (Tem) if the thermoplastic resin has sufficient viscosity or the spring exerts small force. Thus in the present invention an operating temperature can be set within a range set between Tim and Tem, as desired.

EXAMPLE 10

Crystalline polyester is used and an experiment is conducted in connection with setting an operating temperature. For the crystalline polyester, Byron® GM470 and GM990 produced by Toyobo Co., Ltd are used. These are polyester's random copolymer with a plasticizer added thereto. A DSC measurement result is shown in Table 17. Then a test is conducted to examine an operating temperature. A SEFUSE® fuse is tested. Heat distortion temperature is adjusted by a method setting weak compression spring 8 to exert a load having a standard value and that having the standard value multiplied by 1.3. An operating temperature is measured, as shown in Table 18.

TABLE 17 unit (° C.)

| | BYLON | |
|---|---|---|
| | GM470 | GM990 |
| Tpm | 189.1 | 118.4 |
| Tim | 171.1 | 83.5 |
| ΔT | 18.0 | 34.9 |

TABLE 18 unit (° C.)

| | BYLON | | | |
|---|---|---|---|---|
| | GM470 | | GM990 | |
| No. | Standard | ×1.3 | Standard | ×1.3 |
| 1 | 188.3 | 185.6 | 112.3 | 105.2 |
| 2 | 188.2 | 185.5 | 111.2 | 103.2 |
| 3 | 188.2 | 185.5 | 109.5 | 100.3 |
| 4 | 188.1 | 185.3 | 108.7 | 99.5 |
| 5 | 188.0 | 185.2 | 105.6 | 95.3 |
| Average Value | 188.2 | 185.4 | 109.5 | 100.7 |
| Standard Deviation | 0.1 | 0.2 | 2.6 | 3.8 |
| Max. | 188.3 | 185.6 | 112.3 | 105.2 |
| Min. | 188 | 185.2 | 105.6 | 95.3 |
| R | 0.3 | 0.4 | 6.7 | 9.9 |

From these results it has been found that GM470, providing a ΔT of approximately 18° C., provides an operating temperature with a variation falling within ±1° C. and it is found effective to depend on a spring load value to adjust a temperature, whereas GM990, providing a ΔT of approximately 35° C., provides an operating temperature with a large variation (R) and is found to be unable to adjust an operating temperature. More specifically, if ΔT is too large, precision of operation has increased variation (R), and as can be seen in the conventional example of Example 9, if ΔT is too small, precision of operation has a small variation (R), although temperature cannot be adjusted. Furthermore, if copolymerization is applied a plasticizer is added to a material, as seen in Byron, and the material as a thermosensitive material is varied in heat distortion temperature, the material can still be used as a thermosensitive material for the present thermal pellet incorporated thermal fuse. Alternatively, thermosensitive material may be varied in heat distortion temperature by a temperature setting method adding an elastomer, a polymer blend and a plasticizer, a filler, or the like.

EXAMPLE 11

Figure 9:
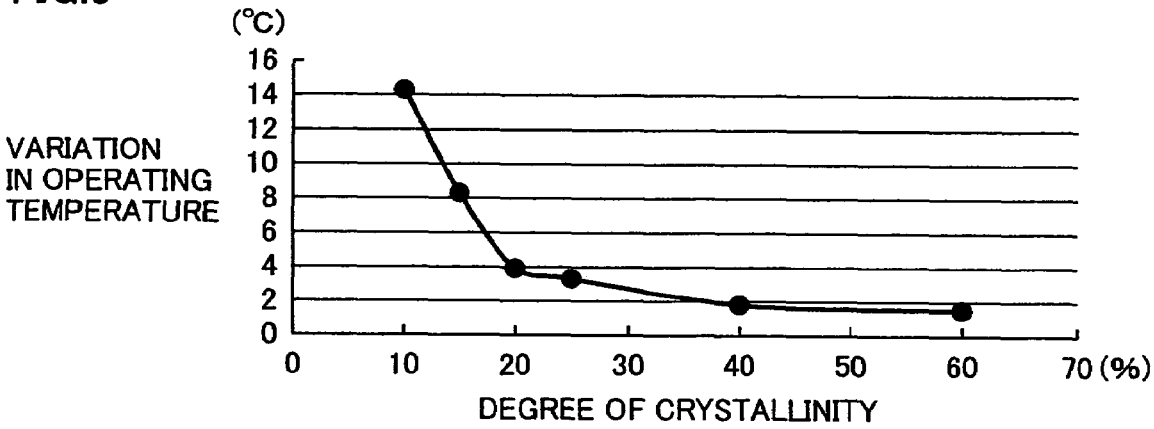
FIG. 9 represents a characteristic showing a relationship between the degree of crystallinity and variation in operating temperature for a thermal pellet for the present thermal fuse.

In the present example an experiment was conducted in connection with selection of crystalline thermoplastic resin depending on degree of crystallinity. To indicate crystalline thermoplastic resin's level of crystallinity, a degree of crystallinity is employed. A thermosensitive material having a degree of crystallinity of 10% to 60% is incorporated in a thermal pellet incorporating thermal fuse (trademark: SEFUSE®) produced by NEC SCHOTT Components Corporation to measure an operating temperature. For each degree of crystallinity, five samples are measured. A maximum operating temperature minus a minimum operating temperature is compared as an operating temperature's variation, as shown in Table 19 and FIG. 9.

TABLE 19

| Degree Of Crystallinity (%) | Operating-Temp. Variation (° C.) |
|---|---|
| 10 | 14.3 |
| 15 | 8.3 |
| 20 | 3.9 |
| 25 | 3.3 |
| 40 | 1.8 |
| 60 | 1.5 |

From these results it has been found that if crystalline thermoplastic resin is selected and used as a thermosensitive material, its degree of crystallinity contributes to a variation of an operating temperature. Typically a thermal fuse is allowed to have an operating temperature with a variation of ±2° C., and it has been found that to satisfy this range, a degree of crystallinity of 20% or more is preferable, and to achieve ±1° C., a further higher precision of operation, a degree of crystallinity of 40% or more is preferable.

A degree of crystallinity can be adjusted by annealing or adding a nucleus creator, and such technique is particularly effective for polyolefin resin providing a high degree of crystallinity. Note that in the present invention a degree of crystallinity also includes an effect of annealing that is caused when it is in use as a product, and it does not necessarily indicate only a degree of crystallinity provided when the product is shipped.

EXAMPLE 12

In the present example an experiment is conducted on a method of setting an operating temperature with pressure plate 4 present/absent. The experiment was conducted with a thermosensitive material provided by Neoflon® FEP, a fluorine resin produced by DAIKIN INDUSTRIES, LTD. An operation test was conducted with SEFUSE® thermal fuses. Note that other methods of setting an operating temperature that depend on a spring's force and a thermosensitive material's dimension and volume are carried out as has been described above, and are performed under an identical condition. An operating temperature was measured, as shown in Table 20.

TABLE 20 unit (° C.)

| No. | Pressure Plate Present | Pressure Plate Absent |
|---|---|---|
| 1 | 268.4 | 263.1 |
| 2 | 268.2 | 262.8 |

TABLE 20-continued unit (° C.)

| No. | Pressure Plate Present | Pressure Plate Absent |
|---|---|---|
| 3 | 268.0 | 262.6 |
| 4 | 267.8 | 262.5 |
| 5 | 266.7 | 262.3 |
| Average Value | 267.8 | 262.7 |
| Standard Deviation | 0.7 | 0.3 |
| Max. | 268.4 | 263.1 |
| Min. | 266.7 | 262.3 |
| R | 1.7 | 0.8 |

It has been found that if a single thermosensitive material is used, pressure plate 4 can be introduced or removed to allow thermal pellet 3 to receive adjusted force to adjust an operating temperature by approximately 5° C. The above description has been made in connection with whether a pressure plate is present or absent, it has also been found that pressure plate 4 can also be varied in size to vary force exerted on the thermal pellet, so that within this range of 5° C., any setting is allowed, and by additionally adjusting the thermosensitive material's dimension and the spring's pressure, a further different operating temperature can be set.

In the present invention a temperature setting method can be applied to allow a single material to operate at different temperatures to allow incorporation in a plurality of thermal pellet incorporating thermal fuses. Furthermore, it has also been found that in addition to selecting a thermosensitive material itself, adjusting thermal distortion temperature by a physical and chemical method can provide a thermal fuse operating at a further different temperature.

Although the present invention has been described and illustrated in detail, it is clearly understood that the same is by way of illustration and example only and is not to be taken by way of limitation, the spirit and scope of the present invention being limited only by the terms of the appended claims.

The invention claimed is:

1. A thermal pellet incorporated thermal fuse comprising:

a cylindrical enclosure accommodating a thermal pellet formed of a thermoplastic resin as a thermosensitive material molded into a pellet, said thermosensitive material being adapted to thermally deform when it is heated;

a first lead member forming a first electrode attached to a first opening of said enclosure;

a second lead member forming a second electrode attached to a second opening of said enclosure;

a movable conductive member accommodated in said enclosure and engaged with said thermal pellet; and a spring accommodated in said enclosure and arranged to exert a force on said movable conductive member;

wherein said thermal pellet has a heat distortion temperature in said thermal fuse adjusted to a desired operating temperature, so that when said thermal pellet, receiving said force exerted by said spring, is heated, said thermal pellet will soften or melt, and thermally deform, at said desired operating temperature and thereby an electric circuit between said first and second electrodes will be switched.

2. The thermal pellet incorporated thermal fuse of claim 1, wherein said thermoplastic resin is an amorphous thermoplastic resin and said heat distortion temperature is adjusted to said desired operating temperature in a temperature range higher than a temperature of a softening point (Tg) of said amorphous thermoplastic resin.

3. The thermal pellet incorporated thermal fuse of claim 1, wherein said thermoplastic resin is a crystalline thermoplastic resin and said heat distortion temperature is adjusted based on a temperature difference between an extrapolated initial melting temperature (Tim) and a peak melting temperature (Tpm) of said crystalline thermoplastic resin.

4. The thermal pellet incorporated thermal fuse of claim 3, wherein said heat distortion temperature is adjusted so that a variation of said operating temperature is set to a selected value based on said temperature difference.

5. The thermal pellet incorporated thermal fuse of claim 3, wherein a degree of crystallinity of said crystalline thermoplastic resin is selected to adjust said heat distortion temperature to said desired operating temperature with a selected precision of operation.

6. The thermal pellet incorporated thermal fuse of claim 3, wherein said thermoplastic resin has been annealed and/or includes a nucleus creator so as to adjust said heat distortion temperature.

7. The thermal pellet incorporated thermal fuse of claim 1, wherein said thermoplastic resin includes at least one resin selected from the group consisting of styrene elastomer, olefin elastomer, polyamide elastomer, urethane elastomer, and polyester elastomer.

8. The thermal pellet incorporated thermal fuse of claim 1, wherein said thermoplastic resin is a polyolefin resin.

9. The thermal pellet incorporated thermal fuse of claim 1, wherein said heat distortion temperature is adjusted based on a polymerization or copolymerization of said thermoplastic resin.

10. The thermal pellet incorporated thermal fuse of claim 1, wherein said thermoplastic resin comprises at least two elastomers or polymers blended together, and said heat distortion temperature is adjusted based on a ratio of blending said elastomers or polymers.

11. The thermal pellet incorporated thermal fuse of claim 1, wherein said thermoplastic resin contains a plasticizer or a filler to adjust said heat distortion temperature.

12. The thermal pellet incorporated thermal fuse of claim 1, wherein said thermal pellet has a physical dimension selected to adjust said heat distortion temperature.

13. The thermal pellet incorporated thermal fuse of claim 1, wherein said thermal pellet has a configuration of a substantial column, a substantial pipe having a substantial cavity therein, or a substantial column having a flat portion with a recess.

14. The thermal pellet incorporated thermal fuse of claim 1, wherein said thermal pellet comprises at least two pellet portions respectively formed of at least two different types of thermoplastic resins, and at least a first one of said pellet portions adjusts said heat distortion temperature to said operating temperature and a second one of said pellet portions at least partially covers said first pellet portion.

15. A method of fabricating the thermal pellet incorporated in the thermal fuse according to claim 1, wherein said thermal pellet is molded by injection molding, extrusion molding, sheet punching and molding, or re-fusion molding.

16. The method of claim 15, wherein said thermal pellet after said molding is then annealed.

17. A thermal pellet incorporated thermal fuse comprising:

a thermal pellet formed of a crystalline thermoplastic resin adapted to fuse or soften at a prescribed temperature;

a cylindrical enclosure accommodating said thermal pellet;

a first lead member forming a first electrode attached to a first opening of said enclosure;

a second lead member forming a second electrode attached to a second opening of said enclosure;

a movable conductive member accommodated in said enclosure and engaged with said thermal pellet; and a spring accommodated in said enclosure and arranged to exert a force on said movable conductive member;

wherein said thermal pellet is adapted to thermally deform at a desired operating temperature to switch an electric circuit between said first and second electrodes, and wherein said thermal pellet exhibits a mass reduction ratio of at most 5% by mass depending on deliquescence or sublimation of said thermal pellet by itself.

18. The thermal pellet incorporated thermal fuse of claim 17, wherein said thermal pellet has said mass reduction ratio of at most 5% by mass due to deliquescence.

19. The thermal pellet incorporated thermal fuse of claim 17, wherein said thermal pellet has said mass reduction ratio of at most 5% by mass due to sublimation.

20. The thermal pellet incorporated thermal fuse of claim 19, wherein said thermal pellet has said mass reduction ratio of at most 5% by mass due to sublimation at said operating temperature.

21. The thermal pellet incorporated thermal fuse of claim 19, wherein said mass reduction ratio is at most 1% by mass due to sublimation at a temperature corresponding to said operating temperature plus at least 50° C.

22. The thermal pellet incorporated thermal fuse of claim 17, wherein said thermal pellet has an insulation property so that said thermal pellet provides an insulation resistance value of at least 0.2 MΩ for at least one minute at a temperature higher than said operating temperature.

23. The thermal pellet incorporated thermal fuse of claim 22, wherein said thermal pellet has said mass reduction ratio of at most 5% by mass due to both deliquescence and sublimation of said thermal pellet.

24. The thermal pellet incorporated thermal fuse of claim 17, wherein said thermal pellet has a configuration of a substantial column, a substantial pipe having a substantial cavity therein, or a substantial column having a flat portion with a recess.

25. The thermal pellet incorporated thermal fuse of claim 17, wherein said thermal pellet comprises at least two pellet portions respectively formed of at least two different types of thermoplastic resins, and at least a first one of said pellet portions adjusts said heat distortion temperature to said operating temperature and a second one of said pellet portions at least partially covers said first pellet portion.

26. A method of fabricating the thermal pellet incorporated in the thermal fuse according to claim 17, wherein said thermal pellet is molded by injection molding, extrusion molding, sheet punching and molding, or re-fusion molding.

27. The method of claim 26, wherein said thermal pellet after said molding is then annealed.

* * * * *